US012410500B2

(12) United States Patent
Das et al.

(10) Patent No.: US 12,410,500 B2
(45) Date of Patent: Sep. 9, 2025

(54) HIGH STRENGTH 6XXX SERIES ALUMINUM ALLOYS AND METHODS OF MAKING THE SAME

(71) Applicant: Novelis Inc., Atlanta, GA (US)

(72) Inventors: Sazol Kumar Das, Acworth, GA (US); Milan Felberbaum, Lausanne (CH)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 18/487,373

(22) Filed: Oct. 16, 2023

(65) Prior Publication Data

US 2024/0035136 A1 Feb. 1, 2024

Related U.S. Application Data

(62) Division of application No. 15/716,657, filed on Sep. 27, 2017, now Pat. No. 11,821,065.
(Continued)

(51) Int. Cl.

| | |
|---|---|
| ***C22C 21/08*** | (2006.01) |
| ***B22D 11/00*** | (2006.01) |
| ***B22D 11/12*** | (2006.01) |
| ***C22C 21/02*** | (2006.01) |
| ***C22C 21/12*** | (2006.01) |
| ***C22C 21/14*** | (2006.01) |
| ***C22C 21/16*** | (2006.01) |

(Continued)

(52) U.S. Cl.
CPC ..... *C22F 1/05* (2013.01); *B22D 11/003* (2013.01); *B22D 11/1206* (2013.01); *C22C 21/02* (2013.01); *C22C 21/08* (2013.01); *C22C 21/12* (2013.01); *C22C 21/14* (2013.01); *C22C 21/16* (2013.01); *C22F 1/04* (2013.01); *C22F 1/043* (2013.01); *C22F 1/053* (2013.01); *C22F 1/057* (2013.01)

(58) Field of Classification Search
CPC ..... C22F 1/04–057
See application file for complete search history.

(56) References Cited

U.S. PATENT DOCUMENTS 3,612,151 A 10/1971 Harrington et al.
3,933,193 A 1/1976 Baker et al.
(Continued)

FOREIGN PATENT DOCUMENTS

CA 2459471 C 2/2010
CA 2900625 A1 8/2014
(Continued)

OTHER PUBLICATIONS

Chinese Application No. 201780066605.2 , "Office Action", Apr. 1, 2024, 17 pages.
(Continued)

*Primary Examiner* — Lois L Zheng
(74) *Attorney, Agent, or Firm* — Kilpatrick Townsend & Stockton LLP

(57) ABSTRACT

Described herein are 6xxx series aluminum alloys with unexpected properties and novel methods of producing such aluminum alloys. The aluminum alloys are highly formable and exhibit high strength. The alloys are produced by continuous casting and can be hot rolled to a final gauge and/or a final temper. The alloys can be used in automotive, transportation, industrial, and electronics applications, just to name a few.

6 Claims, 17 Drawing Sheets

Related U.S. Application Data

(60) Provisional application No. 62/529,028, filed on Jul. 6, 2017, provisional application No. 62/505,944, filed on May 14, 2017, provisional application No. 62/413,740, filed on Oct. 27, 2016, provisional application No. 62/413,591, filed on Oct. 27, 2016.

(51) Int. Cl.

| | |
|---|---|
| ***C22F 1/04*** | (2006.01) |
| ***C22F 1/043*** | (2006.01) |
| ***C22F 1/05*** | (2006.01) |
| ***C22F 1/053*** | (2006.01) |
| ***C22F 1/057*** | (2006.01) |
| *C22C 21/06* | (2006.01) |
| *C22F 1/047* | (2006.01) |

(56) References Cited

U.S. PATENT DOCUMENTS

| | | | |
|---|---|---|---|
| 4,028,141 | A | 6/1977 | Chia et al. |
| 4,174,232 | A | 11/1979 | Lenz et al. |
| 4,194,553 | A | 3/1980 | Kimura et al. |
| 4,238,248 | A | 12/1980 | Gyongyos et al. |
| 4,614,552 | A | 9/1986 | Fortin et al. |
| 4,698,897 | A | 10/1987 | Frommann et al. |
| 4,753,685 | A | 6/1988 | Usui et al. |
| 4,808,247 | A | 2/1989 | Komatsubara et al. |
| 4,823,860 | A | 4/1989 | Lauener |
| 4,869,310 | A | 9/1989 | Yanagi et al. |
| 4,929,421 | A | 5/1990 | Jin et al. |
| 4,976,024 | A | 12/1990 | Kimura |
| 5,046,347 | A | 9/1991 | Crosato et al. |
| 5,244,516 | A | 9/1993 | Kawaguchi |
| 5,437,746 | A | 8/1995 | Usui et al. |
| 5,461,770 | A | 10/1995 | Kimura et al. |
| 5,548,882 | A | 8/1996 | Windhaus et al. |
| 5,560,789 | A | 10/1996 | Sainfort et al. |
| 5,720,335 | A | 2/1998 | Osada et al. |
| 5,779,824 | A | 7/1998 | Sawada et al. |
| 6,289,972 | B1 | 9/2001 | Benedetti |
| 6,471,796 | B1 | 10/2002 | Kagohara et al. |
| 6,579,387 | B1 | 6/2003 | Selepack et al. |
| 6,755,236 | B1 | 6/2004 | Sivilotti et al. |
| 6,789,602 | B2 | 9/2004 | Li et al. |
| 7,182,825 | B2 | 2/2007 | Unal et al. |
| 7,380,583 | B2 | 6/2008 | Gallerneault et al. |
| 7,448,432 | B2 | 11/2008 | Barker et al. |
| 10,493,508 | B2 | 12/2019 | Bassi et al. |
| 10,533,243 | B2 | 1/2020 | Newman et al. |
| 10,550,455 | B2 | 2/2020 | Hosch et al. |
| 2003/0150587 | A1 | 8/2003 | Li et al. |
| 2003/0173003 | A1 | 9/2003 | Selepack et al. |
| 2004/0011438 | A1 | 1/2004 | Lorentzen et al. |
| 2004/0089382 | A1 | 5/2004 | Senkov et al. |
| 2004/0094245 | A1 | 5/2004 | Li et al. |
| 2004/0129353 | A1 | 7/2004 | Verma et al. |
| 2005/0028894 | A1 | 2/2005 | Hoffmann et al. |
| 2005/0086784 | A1 | 4/2005 | Li et al. |
| 2005/0211350 | A1 | 9/2005 | Unal et al. |
| 2007/0209739 | A1 | 9/2007 | Zhao |
| 2008/0035301 | A1 | 2/2008 | Arvedi |
| 2009/0178778 | A1 | 7/2009 | Seidel et al. |
| 2010/0212856 | A1 | 8/2010 | Rosenthal et al. |
| 2011/0111081 | A1 | 5/2011 | Chen et al. |
| 2012/0024434 | A1 | 2/2012 | Franz et al. |
| 2013/0334091 | A1 | 12/2013 | Sawtell |
| 2014/0000768 | A1 | 1/2014 | Sawtell et al. |
| 2014/0250963 | A1 | 9/2014 | Nelson et al. |
| 2015/0071816 | A1 | 3/2015 | Unal et al. |
| 2015/0218679 | A1 | 8/2015 | Aruga et al. |
| 2015/0252461 | A1 | 9/2015 | Kokubo et al. |
| 2015/0328670 | A1 | 11/2015 | Alken et al. |
| 2017/0175240 | A1 | 6/2017 | Wen et al. |
| 2017/0198376 | A1 | 7/2017 | Newman et al. |
| 2018/0087138 | A1 | 3/2018 | Gaensbauer et al. |
| 2018/0112296 | A1 | 4/2018 | Bryant et al. |
| 2018/0112298 | A1 | 4/2018 | Weykamp |
| 2018/0117650 | A1 | 5/2018 | Felberbaum et al. |
| 2018/0117669 | A1 | 5/2018 | Felberbaum et al. |
| 2018/0119262 | A1 | 5/2018 | Felberbaum et al. |
| 2018/0274072 | A1* | 9/2018 | Das ..... B22D 15/005 |
| 2018/0297092 | A1 | 10/2018 | Chung et al. |
| 2019/0022720 | A1 | 1/2019 | Shafiei et al. |
| 2019/0022721 | A1 | 1/2019 | Shafiei et al. |
| 2019/0022724 | A1 | 1/2019 | Shafiei et al. |
| 2019/0054519 | A1 | 2/2019 | Barker |

FOREIGN PATENT DOCUMENTS

| | | | |
|---|---|---|---|
| CN | 1200771 | A | 12/1998 |
| CN | 1207965 | A | 2/1999 |
| CN | 1505692 | A | 6/2004 |
| CN | 1662670 | A | 8/2005 |
| CN | 1942595 | A | 4/2007 |
| CN | 101896631 | A | 11/2010 |
| CN | 102413955 | A | 4/2012 |
| CN | 103119185 | A | 5/2013 |
| CN | 103131904 | A | 6/2013 |
| CN | 103510029 | A | 1/2014 |
| CN | 103764305 | A | 4/2014 |
| CN | 104093868 | A | 10/2014 |
| CN | 104109784 | A | 10/2014 |
| CN | 104284745 | A | 1/2015 |
| CN | 104321451 | A | 1/2015 |
| CN | 104364409 | A | 2/2015 |
| CN | 104411846 | A | 3/2015 |
| CN | 104583433 | A | 4/2015 |
| CN | 104762575 | A | 7/2015 |
| CN | 204817969 | U | 12/2015 |
| CN | 105397045 | A | 3/2016 |
| CN | 105734369 | A | 7/2016 |
| CN | 105814222 | A | 7/2016 |
| EP | 2813592 | A1 | 12/2014 |
| GB | 1387992 | A | 3/1975 |
| GB | 2027743 | A | 2/1980 |
| JP | 60152348 | A | 8/1985 |
| JP | 60201839 | A | 10/1985 |
| JP | 6283453 | A | 4/1987 |
| JP | 6289502 | A | 4/1987 |
| JP | 63252604 | A | 10/1988 |
| JP | 06322493 | A | 11/1994 |
| JP | H0790459 | A | 4/1995 |
| JP | 07252573 | A | 10/1995 |
| JP | 09327706 | A | 12/1997 |
| JP | 10502973 | A | 3/1998 |
| JP | 10130768 | A | 5/1998 |
| JP | 2000017412 | A | 1/2000 |
| JP | 2000210760 | A | 8/2000 |
| JP | 2000212673 | A | 8/2000 |
| JP | 2001518140 | A | 10/2001 |
| JP | 2006299420 | A | 11/2006 |
| JP | 2007031819 | A | 2/2007 |
| JP | 2007262484 | A | 10/2007 |
| JP | 2008076297 | A | 4/2008 |
| JP | 2008190022 | A | 8/2008 |
| JP | 2014047384 | A | 3/2014 |
| JP | 2014219222 | A | 11/2014 |
| JP | 2016160515 | A | 9/2016 |
| JP | 2016160516 | A | 9/2016 |
| KR | 940010443 | B1 | 10/1994 |
| KR | 20080014744 | A | 2/2008 |
| KR | 20140134315 | A | 11/2014 |
| KR | 20150023006 | A | 3/2015 |
| RU | 99126709 | A | 10/2001 |
| RU | 2292967 | C2 | 2/2007 |
| RU | 2299256 | C1 | 5/2007 |
| RU | 2305022 | C1 | 8/2007 |
| RU | 2313594 | C1 | 12/2007 |
| RU | 2008139893 | A | 4/2010 |
| RU | 2397842 | C1 | 8/2010 |
| RU | 102550 | U1 | 3/2011 |
| RU | 2415193 | C1 | 3/2011 |
| SU | 1306484 | A3 | 4/1987 |

(56) References Cited

FOREIGN PATENT DOCUMENTS

| | | | |
|---|---|---|---|
| WO | 9711205 | A1 | 3/1997 |
| WO | 0037190 | A1 | 6/2000 |
| WO | 0144532 | A1 | 6/2001 |
| WO | 2008003504 | A2 | 1/2008 |
| WO | 2008016169 | A1 | 2/2008 |
| WO | 2013133960 | A1 | 9/2013 |
| WO | 2015058902 | A1 | 4/2015 |
| WO | 2016090026 | A1 | 6/2016 |

OTHER PUBLICATIONS

Korean Application No. 10-2023-7004069 , "Notice of Decision to Grant", Feb. 16, 2024, 5 pages.
Korean Application No. 10-2023-7004069 , "Office Action", Oct. 26, 2023, 6 pages.
Li et al., "Luhejin Shengchan Shebei Ji Shiyong Weihu Jishu", Metallurgical Industry Press, Edition 1, Jan. 2013, 35 pages.
Rong et al., "Japan Industrial Furnace Handbook", Compiled by Japan Industrial Furnace Manufacture Association, Metallurgical Industry Press, Edition 1, Apr. 1989, 23 pages.
U.S. Appl. No. 15/716,657 , "Advisory Action", Sep. 14, 2020, 3 pages.
U.S. Appl. No. 15/716,657 , "Final Office Action", Jun. 25, 2020, 6 pages.
U.S. Appl. No. 15/716,657 , "Final Office Action", Nov. 12, 2021, 8 pages.
U.S. Appl. No. 15/716,657 , "Final Office Action", Aug. 18, 2022, 9 pages.
U.S. Appl. No. 15/716,657 , "Final Office Action", May 23, 2023, 9 pages.
U.S. Appl. No. 15/716,657 , "Non-Final Office Action", Mar. 6, 2020, 6 pages.
U.S. Appl. No. 15/716,657 , "Non-Final Office Action", May 27, 2021, 6 pages.
U.S. Appl. No. 15/716,657 , "Non-Final Office Action", Dec. 21, 2022, 9 pages.
U.S. Appl. No. 15/716,657 , "Non-Final Office Action", Mar. 31, 2022, 9 pages.
U.S. Appl. No. 15/716,657 , "Notice of Allowance", Sep. 5, 2023, 8 pages.
AU2017350515 , "First Examination Report", Aug. 29, 2019, 3 pages.
AU2017350515 , "Notice of Acceptance", Feb. 26, 2020, 3 pages.
BR112019007379-5 , "Office Action", Jul. 27, 2021, 4 pages.
BR112019007379-5 , "Office Action", May 3, 2022, 4 pages.
CA3,041,562 , "Notice of Allowance", Feb. 14, 2022, 1 page.
CA3,041,562 , "Office Action", Jun. 2, 2021, 3 pages.
CA3,041,562 , "Office Action", Dec. 8, 2020, 4 pages.
CA3,041,562 , "Office Action", May 7, 2020, 5 pages.
CN201780066605.2 , "Office Action", Apr. 19, 2021, 10 pages.
CN201780066605.2 , "Office Action", Aug. 2, 2021, 10 pages.
CN201780066605.2 , "Office Action", Jul. 28, 2020, 23 pages.
Davis , "Aluminum and Aluminum Alloys", ASM International, 1993, 6 pages.
EP17790885.2 , "Intention to Grant", Jan. 9, 2023, 5 pages.
EP17790885.2 , "Office Action", Apr. 6, 2021, 4 pages.
EP17790885.2 , "Office Action", Dec. 7, 2021, 4 pages.
EP17790885.2 , "Office Action", Jul. 23, 2021, 4 pages.
EP17790885.2 , "Office Action", Jun. 15, 2022, 5 pages.
EP17790885.2 , "Office Action", Mar. 16, 2020, 5 pages.
EP17790885.2 , "Office Action", Oct. 19, 2020, 5 pages.
IN201917016395 , "First Examination Report", Dec. 14, 2020, 7 pages.
JP2019-520573 , "Notice of Decision to Grant", May 17, 2022, 2 pages.
JP2019-520573 , "Office Action", May 26, 2020, 14 pages.
JP2019-520573 , "Office Action", Dec. 14, 2021, 15 pages.
JP2019-520573 , "Office Action", Feb. 2, 2021, 6 pages.
KR10-2019-7014790 , "Office Action", Oct. 21, 2020, 12 pages.
KR10-2019-7014790 , "Office Action", Jun. 21, 2021, 7 pages.
KR10-2019-7014790 , "Office Action", May 12, 2021, 7 pages.
KR10-2021-7023150 , "Office Action", Oct. 25, 2021, 3 pages.
KR10-2021-7023150 , "Office Action", Dec. 7, 2022, 5 pages.
KR10-2021-7023150 , "Office Action", Aug. 30, 2022, 8 pages.
KR10-2023-7004069 , "Office Action", Jul. 5, 2023, 8 pages.
Li et al., "Aluminum Alloy Material and Heat Treatment Process", Metallurgical Industry Press, Apr. 30, 2012, 6 pages.
Lohne et al., "Quench Sensitivity in AlMgSi Alloys Containing Manganese or Chromium", Scandinavian Journal of Metallurgy, vol. 12, 1983, pp. 34-36.
MX/A/2019/004839 , "Notice of Allowance", Aug. 11, 2023, 3 pages.
MX/A/2019/004839 , "Office Action", Jun. 13, 2023, 4 pages.
PCT/US2017/053749 , "International Preliminary Report on Patentability", May 9, 2019, 9 pages.
PCT/US2017/053749 , "International Search Report and Written Opinion", Dec. 8, 2017, 15 pages.
Prince et al., "The Effects of Dispersoids Upon the Micromechanisms of Crack Propagation in Al—Mg—Si Alloys", Acta Metallurgical, vol. 27, No. 8, Aug. 1979, pp. 1401-1408.
RU2019112640 , "Notice of Decision to Grant", Mar. 26, 2020, 14 pages.
RU2019112640 , "Office Action", Dec. 20, 2019, 11 pages.
Song et al., "The Role of Tin in the Hot-Ductility Deterioration of a Low-Carbon Steel", Metallurgical and Materials Transactions A, vol. 34, No. 8, Aug. 2003, pp. 1611-1616.
Tong et al., "5000 Questions on New Technology of Energy Saving and Emission Reduction in Steel Works", China Science and Technology Press, Jul. 31, 2009, 4 pages.
Wang et al., "Introduction to Constructive Material Science", Shanghai Science and Technology Press, Feb. 28, 1987, 4 pages.
Zhao et al., "Effect of Mn Contents on the Bake Hardenability and Bendability of Al-0.6mass%Mg-0.8mass%Si Alloy Sheets", Journal of Japan Institute of Light Metals, vol. 55, No. 5, 2005, pp. 227-232.

* cited by examiner

HIGH STRENGTH 6XXX SERIES ALUMINUM ALLOYS AND METHODS OF MAKING THE SAME

CROSS-REFERENCE TO RELATED APPLICATIONS

This application is a divisional of U.S. patent application Ser. No. 15/716,657 filed Sep. 27, 2017 and titled "HIGH STRENGTH 6XXX SERIES ALUMINUM ALLOYS AND METHODS OF MAKING THE SAME", which claims the benefit of U.S. Provisional Application Nos. 62/413,740, filed Oct. 27, 2016 and titled "HIGH STRENGTH 6XXX SERIES ALUMINUM ALLOY AND METHODS OF MAKING THE SAME"; 62/529,028, filed Jul. 6, 2017 and titled "SYSTEMS AND METHODS FOR MAKING ALUMINUM ALLOY PLATES"; 62/413,591, filed Oct. 27, 2016 and titled "DECOUPLED CONTINUOUS CASTING AND ROLLING LINE"; and 62/505,944, filed May 14, 2017 and titled "DECOUPLED CONTINUOUS CASTING AND ROLLING LINE", the contents of all of which are incorporated herein by reference in their entireties.

Additionally, the present application is related to U.S. Non-Provisional patent application Ser. No. 15/717,361 to Milan Felberbaum et al., entitled "METAL CASTING AND ROLLING LINE" filed Sep. 27, 2017, the disclosure of which is hereby incorporated by reference in its entirety.

FIELD

The present disclosure relates to the fields of materials science, materials chemistry, metal manufacturing, aluminum alloys, and aluminum manufacturing.

BACKGROUND

Aluminum (Al) alloys are increasingly replacing steel and other metals in multiple applications, such as automotive, transportation, industrial, or electronics-related applications. In some applications, such alloys may need to exhibit high strength, high formability, corrosion resistance, and/or low weight. However, producing alloys having the aforementioned properties is a challenge, as conventional methods and compositions may not achieve the necessary requirements, specifications, and/or performances required for the different applications when produced via established methods. For example, aluminum alloys with a high solute content, including copper (Cu), magnesium (Mg), and zinc (Zn), can lead to cracking when ingots are direct chill (DC) cast.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Provided herein are aluminum alloys that exhibit high strength and high formability, and do not exhibit cracking during and/or after casting, along with methods of making and processing the alloys. The alloys can be used in automotive, transportation, industrial, and electronics applications, to name a few.

In some examples, a method of producing an aluminum alloy comprises continuously casting an aluminum alloy to form a slab, wherein the aluminum alloy comprises about 0.26-2.82 wt. % Si, 0.06-0.60 wt. % Fe, 0.26-2.37 wt. % Cu, 0.06-0.57 wt. % Mn, 0.26-2.37 wt. % Mg, 0-0.21 wt. % Cr, 0-0.009 wt. % Zn, 0-0.09 wt. % Ti, 0-0.003 wt. % Zr and up to wt. % of impurities, with the remainder Al, and hot rolling the slab to a final gauge without cold rolling the slab prior to the final gauge. In some cases, the aluminum alloy comprises about 0.26-2.82 wt. % Si, 0.06-0.60 wt. % Fe, 0.26-2.37 wt. % Cu, 0.06-0.57 wt. % Mn, 0.26-2.37 wt. % Mg, 0.02-0.21 wt. % Cr, 0.001-0.009 wt. % Zn, 0.006-0.09 wt. % Ti, 0.0003-0.003 wt. % Zr and up to 0.15 wt. % of impurities, with the remainder Al. In some examples, the aluminum alloys comprise about 0.52-1.18 wt. % Si, 0.13-0.30 wt. % Fe, 0.52-1.18 wt. % Cu, 0.12-0.28 wt. % Mn, 0.52-1.18 wt. % Mg, 0.04-0.10 wt. % Cr, 0.002-0.006 wt. % Zn, 0.01-0.06 wt. % Ti, 0.0006-0.001 wt. % Zr and up to 0.15 wt. % of impurities, with the remainder Al. In some further examples, the aluminum alloys comprise about 0.70-1.0 wt. % Si, 0.15-0.25 wt. % Fe, 0.70-0.90 wt. % Cu, 0.15-0.25 wt. % Mn, 0.70-0.90 wt. % Mg, 0.05-0.10 wt. % Cr, 0.002-0.004 wt. % Zn, 0.01-0.03 wt. % Ti, 0.0006-0.001 wt. % Zr and up to 0.15 wt. % of impurities, with the remainder Al. In some cases, the continuously cast slab is coiled before the step of hot rolling the slab. Optionally, the method further comprises cooling the slab upon exit from a continuous caster that continuously cast the slab. The cooling can comprise quenching the slab with water and/or air cooling the slab. In some cases, the method can include coiling the slab into an intermediate coil before the step of hot rolling the slab to the final gauge; preheating the intermediate coil before hot rolling the slab to the final gauge; and homogenizing the intermediate coil before hot rolling the slab to the final gauge. Optionally, the method can further comprise solutionizing the aluminum alloy product of the final gauge; quenching the aluminum alloy product of the final gauge; and aging the aluminum alloy product of the final gauge. Optionally, a cold rolling step is not performed. In some cases, the slab is devoid of cracks having a length greater than about 8.0 mm after the continuously casting step and before the hot rolling step.

In other examples, a method of producing an aluminum alloy product comprises continuously casting an aluminum alloy to form a slab, wherein the aluminum alloy comprises about 0.26-2.82 wt. % Si, 0.06-0.60 wt. % Fe, 0.26-2.37 wt. % Cu, 0.06-0.57 wt. % Mn, 0.26-2.37 wt. % Mg, 0-0.21 wt. % Cr, 0-0.009 wt. % Zn, 0-0.09 wt. % Ti, 0-0.003 wt. % Zr and up to 0.15 wt. % of impurities, with the remainder Al, and hot rolling the slab to a final gauge and a final temper. In some cases, the aluminum alloy comprises about 0.26-2.82 wt. % Si, 0.06-0.60 wt. % Fe, 0.26-2.37 wt. % Cu, 0.06-0.57 wt. % Mn, 0.26-2.37 wt. % Mg, 0.02-0.21 wt. % Cr, 0.001-0.009 wt. % Zn, 0.006-0.09 wt. % Ti, 0.0003-0.003 wt. % Zr and up to 0.15 wt. % of impurities, with the remainder Al. In some examples, the aluminum alloys comprise about 0.52-1.18 wt. % Si, 0.13-0.30 wt. % Fe, 0.52-1.18 wt. % Cu, 0.12-0.28 wt. % Mn, 0.52-1.18 wt. % Mg, 0.04-0.10 wt. % Cr, 0.002-0.006 wt. % Zn, 0.01-0.06 wt. % Ti, 0.0006-0.001 wt. % Zr and up to 0.15 wt. % of impurities, with the remainder Al. In some further examples, the aluminum alloys comprise about 0.70-1.0 wt. % Si, 0.15-0.25 wt. % Fe, 0.70-0.90 wt. % Cu, 0.15-0.25 wt. % Mn, 0.70-0.90 wt. % Mg, 0.05-0.10 wt. % Cr, 0.002-0.004 wt. % Zn, 0.01-0.03 wt. % Ti, 0.0006-0.001 wt. % Zr and up to 0.15 wt. % of impurities, with the remainder Al. In some cases, the cast slab does not exhibit cracking during and/or after casting. In some cases, the slab is devoid of cracks having a length greater than about 8.0 mm after the continuously casting step and before the hot rolling step.

In some examples, a method of producing an aluminum alloy product comprises continuously casting an aluminum alloy in a continuous caster to form a slab, wherein the aluminum alloy comprises about 0.26-2.82 wt. % Si, 0.06-0.60 wt. % Fe, 0.26-2.37 wt. % Cu, 0.06-0.57 wt. % Mn, 0.26-2.37 wt. % Mg, 0-0.21 wt. % Cr, 0-0.009 wt. % Zn, 0-0.09 wt. % Ti, 0-0.003 wt. % Zr and up to 0.15 wt. % of impurities, with the remainder Al; homogenizing the slab upon exit from the continuous caster; and hot rolling the slab to reduce a thickness of the slab by at least 50%. In some cases, the aluminum alloy comprises about 0.26-2.82 wt. % Si, 0.06-0.60 wt. % Fe, 0.26-2.37 wt. % Cu, 0.06-0.57 wt. % Mn, 0.26-2.37 wt. % Mg, 0.02-0.21 wt. % Cr, 0.001-0.009 wt. % Zn, 0.006-0.09 wt. % Ti, 0.0003-0.003 wt. % Zr and up to 0.15 wt. % of impurities, with the remainder Al. In some examples, the aluminum alloys comprise about 0.52-1.18 wt. % Si, 0.13-0.30 wt. % Fe, 0.52-1.18 wt. % Cu, 0.12-0.28 wt. % Mn, 0.52-1.18 wt. % Mg, 0.04-0.10 wt. % Cr, 0.002-0.006 wt. % Zn, 0.01-0.06 wt. % Ti, 0.0006-0.001 wt. % Zr and up to 0.15 wt. % of impurities, with the remainder Al. In some further examples, the aluminum alloys comprise about 0.70-1.0 wt. % Si, 0.15-0.25 wt. % Fe, 0.70-0.90 wt. % Cu, 0.15-0.25 wt. % Mn, 0.70-0.90 wt. % Mg, 0.05-0.10 wt. % Cr, 0.002-0.004 wt. % Zn, 0.01-0.03 wt. % Ti, 0.0006-0.001 wt. % Zr and up to 0.15 wt. % of impurities, with the remainder Al. Optionally, the homogenizing step is performed at a temperature from about 500° C. to about 580° C.

Also provided herein are aluminum alloy products prepared according to the methods described herein. The aluminum alloy product can be an aluminum alloy sheet, an aluminum alloy plate, or an aluminum alloy shate. The aluminum alloy product can comprise a long transverse tensile yield strength of at least about 365 MPa when in a T82-temper. The aluminum alloy product can comprise a bend angle of from about 40° to about 130° when in a T4-temper. Optionally, the aluminum alloy product can comprise an interior bend angle of from about 35° to about 65° when in a T4-temper, from about 110° to about 130° when in a T82-temper, and from about 90° to about 130° when in a semi-crash condition. The aluminum alloy product can be an automotive body part, a motor vehicle part, a transportation body part, an aerospace body part, or an electronics housing.

The aluminum alloys prepared according to the methods described herein have unexpected properties. For example, continuously cast 6xxx series aluminum alloys processed without a cold rolling step exhibit the ductility expected of an aluminum alloy that was not subjected to strain hardening by cold rolling, while concomitantly exhibiting tensile strengths usually gained from a cold rolling step. Aluminum alloys described herein produced by continuous casting further exhibit resistance to cracking commonly observed in alloys of the described compositions cast by a non-continuous direct chill (DC) method.

Other objects and advantages of the invention will be apparent from the following detailed description of embodiments of the invention and figures.

BRIEF DESCRIPTION OF THE FIGURES

FIG. 1A shows a comparative process route wherein an as-cast aluminum alloy ("As cast") is subjected to a pre-heating step ("Pre-heat"), a hot rolling step ("Lab HR"), a quenching/coil cooling step ("Reroll"), a cold rolling step ("Lab CR") to result in a final gauge product ("Final gauge"), a solutionizing step to result in a solution heat treated product ("SHT"), and an aging step to result in an aged product ("AA"). FIG. 1B shows an exemplary process route wherein an as-cast aluminum alloy ("As cast") is subjected to a pre-heating step ("Pre-heat"), a hot rolling to final gauge step ("Lab HR") to result in a final gauge product ("Final gauge"), a solutionizing step to result in a solution heat treated product ("SHT"), and an aging step to result in an aged product ("AA").

DETAILED DESCRIPTION

Figure 1A:
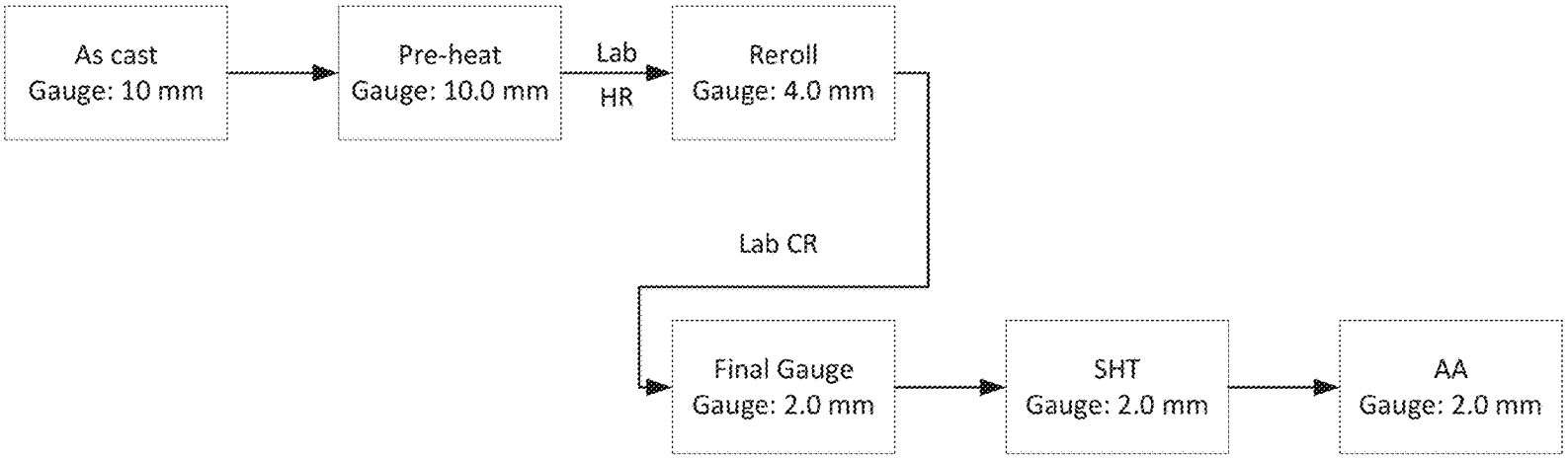
FIGS. 1A and 1B are process flow charts showing two different processing routes for different alloys described herein.

Described herein are 6xxx series aluminum alloys which exhibit high strength and high formability. In some cases, 6xxx series aluminum alloys can be difficult to cast using conventional casting processes due to their high solute content. Methods described herein permit the casting of the 6xxx series aluminum alloys described herein in thin slabs (e.g., aluminum alloy bodies with a thickness of from about 5 mm to about 50 mm), free from cracking during and/or after casting as determined by visual inspection (e.g., there are fewer cracks per square meter in the slab prepared according to methods described herein than in a direct chill cast ingot). In some examples, 6xxx series aluminum alloys can be continuously cast, as described herein. In some further examples, by including a water quenching step upon exit from the caster, the solutes can freeze in the matrix, rather than precipitating out of the matrix. In some cases, the freezing of the solute in the matrix can prevent coarsening of the precipitates in downstream processing.

Definitions and Descriptions

The terms "invention," "the invention," "this invention" and "the present invention," as used in this document, are intended to refer broadly to all of the subject matter of this patent application and the claims below. Statements containing these terms should be understood not to limit the subject matter described herein or to limit the meaning or scope of the patent claims below.

As used herein, the meaning of "a," "an," and "the" includes singular and plural references unless the context clearly dictates otherwise.

As used herein, the meaning of "metals" includes pure metals, alloys and metal solid solutions unless the context clearly dictates otherwise.

In this description, reference is made to alloys identified by AA numbers and other related designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T1 condition or temper refers to an aluminum alloy after cooling from hot working and natural aging (e.g., at room temperature). A T2 condition or temper refers to an aluminum alloy after cooling from hot working, cold working, and natural aging. A T3 condition or temper refers to an aluminum alloy after solution heat treatment (i.e., solutionization), cold working, and natural aging. A T4 condition or temper refers to an aluminum alloy after solution heat treatment followed by natural aging. A T5 condition or temper refers to an aluminum alloy after cooling from hot working and artificial aging. A T6 condition or temper refers to an aluminum alloy after solution heat treatment followed by artificial aging (AA). A T7 condition or temper refers to an aluminum alloy after solution heat treatment and then artificially overaging. A T8x condition or temper refers to an aluminum alloy after solution heat treatment, followed by cold working and then by artificial aging. A T9 condition or temper refers to an aluminum alloy after solution heat treatment, followed by artificial aging, and then by cold working.

As used herein, a plate generally has a thickness of greater than about 15 mm. For example, a plate may refer to an aluminum product having a thickness of greater than 15 mm, greater than 20 mm, greater than 25 mm, greater than 30 mm, greater than 35 mm, greater than 40 mm, greater than 45 mm, greater than 50 mm, or greater than 100 mm.

As used herein, a shate (also referred to as a sheet plate) generally has a thickness of from about 4 mm to about 15 mm. For example, a shate may have a thickness of 4 mm, 5 mm, 6 mm, 7 mm, 8 mm, 9 mm, 10 mm, 11 mm, 12 mm, 13 mm, 14 mm, or 15 mm.

As used herein, a sheet generally refers to an aluminum product having a thickness of less than about 4 mm. For example, a sheet may have a thickness of less than 4 mm, less than 3 mm, less than 2 mm, less than 1 mm, less than 0.5 mm, less than 0.3 mm, or less than 0.1 mm.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

In the following examples, the aluminum alloys are described in terms of their elemental composition in weight percentage (wt. %) of the whole. In each alloy, the remainder is aluminum with a maximum wt. % of 0.15 wt. % for all impurities.

Alloy Composition

The alloys described herein are aluminum-containing 6xxx series alloys. The alloys exhibit unexpectedly high strength and high formability. In some cases, the properties of the alloys can be achieved due to the elemental composition of the alloys. Specifically, the alloys can have the following elemental composition as provided in Table 1.

TABLE 1

| Element | Weight Percentage (wt. %) |
|---|---|
| Si | 0.26-2.82 |
| Fe | 0.06-0.60 |
| Cu | 0.26-2.37 |
| Mn | 0.06-0.57 |
| Mg | 0.26-2.37 |
| Cr | 0-0.21 |
| Zn | 0-0.009 |
| Ti | 0-0.09 |
| Zr | 0-0.003 |
| Impurities | 0-0.05 (each)<br>0-0.15 (total) |
| Al | Remainder |

In some examples, the alloy can have an elemental composition as provided in Table 2.

TABLE 2

| Element | Weight Percentage (wt. %) |
|---|---|
| Si | 0.26-2.82 |
| Fe | 0.06-0.60 |
| Cu | 0.26-2.37 |
| Mn | 0.06-0.57 |
| Mg | 0.26-2.37 |
| Cr | 0.02-0.21 |
| Zn | 0.001-0.009 |
| Ti | 0.006-0.09 |
| Zr | 0.0003-0.003 |
| Impurities | 0-0.05 (each)<br>0-0.15 (total) |
| Al | Remainder |

In some examples, the alloy can have an elemental composition as provided in Table 3.

TABLE 3

| Element | Weight Percentage (wt. %) |
|---|---|
| Si | 0.52-1.18 |
| Fe | 0.13-0.30 |
| Cu | 0.52-1.18 |
| Mn | 0.12-0.28 |
| Mg | 0.52-1.18 |
| Cr | 0.04-0.10 |
| Zn | 0.002-0.006 |
| Ti | 0.01-0.06 |
| Zr | 0.0006-0.001 |
| Impurities | 0-0.05 (each)<br>0-0.15 (total) |
| Al | Remainder |

In some examples, the alloy can have the following elemental composition as provided in Table 4.

TABLE 4

| Element | Weight Percentage (wt. %) |
|---|---|
| Si | 0.70-1.0 |
| Fe | 0.15-0.25 |
| Cu | 0.70-0.90 |
| Mn | 0.15-0.25 |
| Mg | 0.70-0.90 |
| Cr | 0.05-0.10 |
| Zn | 0.002-0.004 |
| Ti | 0.01-0.03 |
| Zr | 0.0006-0.001 |
| Impurities | 0-0.05 (each)<br>0-0.15 (total) |
| Al | Remainder |

In some examples, the alloy described herein includes silicon (Si) in an amount of from about 0.26 wt. % to about 2.82 wt. % (e.g., from 0.52 wt. % to 1.18 wt. % or from 0.70 wt. % to 1.0 wt. %) based on the total weight of the alloy. For example, the alloy can include 0.26 wt. %, 0.27 wt. %, 0.28 wt. %, 0.29 wt. %, 0.3 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.4 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.5 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, 0.6 wt. %, 0.61 wt. %, 0.62 wt. %, 0.63 wt. %, 0.64 wt. %, 0.65 wt. %, 0.66 wt. %, 0.67 wt. %, 0.68 wt. %, 0.69 wt. %, 0.7 wt. %, 0.71 wt. %, 0.72 wt. %, 0.73 wt. %, 0.74 wt. %, 0.75 wt. %, 0.76 wt. %, 0.77 wt. %, 0.78 wt. %, 0.79 wt. %, 0.8 wt. %, 0.81 wt. %, 0.82 wt. %, 0.83 wt. %, 0.84 wt. %, 0.85 wt. %, 0.86 wt. %, 0.87 wt. %, 0.88 wt. %, 0.89 wt. %, 0.9 wt. %, 0.91 wt. %, 0.92 wt. %, 0.93 wt. %, 0.94 wt. %, 0.95 wt. %, 0.96 wt. %, 0.97 wt. %, 0.98 wt. %, 0.99 wt. %, 1.0 wt. %, 1.01 wt. %, 1.02 wt. %, 1.03 wt. %, 1.04 wt. %, 1.05 wt. %, 1.06 wt. %, 1.07 wt. %, 1.08 wt. %, 1.09 wt. %, 1.1 wt. %, 1.11 wt. %, 1.12 wt. %, 1.13 wt. %, 1.14 wt. %, 1.15 wt. %, 1.16 wt. %, 1.17 wt. %, 1.18 wt. %, 1.19 wt. %, 1.2 wt. %, 1.21 wt. %, 1.22 wt. %, 1.23 wt. %, 1.24 wt. %, 1.25 wt. %, 1.26 wt. %, 1.27 wt. %, 1.28 wt. %, 1.29 wt. %, 1.3 wt. %, 1.31 wt. %, 1.32 wt. %, 1.33 wt. %, 1.34 wt. %, 1.35 wt. %, 1.36 wt. %, 1.37 wt. %, 1.38 wt. %, 1.39 wt. %, 1.4 wt. %, 1.41 wt. %, 1.42 wt. %, 1.43 wt. %, 1.44 wt. %, 1.45 wt. %, 1.46 wt. %, 1.47 wt. %, 1.48 wt. %, 1.49 wt. %, 1.5 wt. %, 1.51 wt. %, 1.52 wt. %, 1.53 wt. %, 1.54 wt. %, 1.55 wt. %, 1.56 wt. %, 1.57 wt. %, 1.58 wt. %, 1.59 wt. %, 1.6 wt. %, 1.61 wt. %, 1.62 wt. %, 1.63 wt. %, 1.64 wt. %, 1.65 wt. %, 1.66 wt. %, 1.67 wt. %, 1.68 wt. %, 1.69 wt. %, 1.7 wt. %, 1.71 wt. %, 1.72 wt. %, 1.73 wt. %, 1.74 wt. %, 1.75 wt. %, 1.76 wt. %, 1.77 wt. %, 1.78 wt. %, 1.79 wt. %, 1.80 wt. %, 1.81 wt. %, 1.82 wt. %, 1.83 wt. %, 1.84 wt. %, 1.85 wt. %, 1.86 wt. %, 1.87 wt. %, 1.88 wt. %, 1.89 wt. %, 1.9 wt. %, 1.91 wt. %, 1.92 wt. %, 1.93 wt. %, 1.94 wt. %, 1.95 wt. %, 1.96 wt. %, 1.97 wt. %, 1.98 wt. %, 1.99 wt. %, 2.0 wt. %, 2.01 wt. %, 2.02 wt. %, 2.03 wt. %, 2.04 wt. %, 2.05 wt. %, 2.06 wt. %, 2.07 wt. %, 2.08 wt. %, 2.09 wt. %, 2.1 wt. % 2.11 wt. %, 2.12 wt. %, 2.13 wt. %, 2.14 wt. %, 2.15 wt. %, 2.16 wt. %, 2.17 wt. %, 2.18 wt. %, 2.19 wt. %, 2.2 wt. %, 2.21 wt. %, 2.22 wt. %, 2.23 wt. %, 2.24 wt. %, 2.25 wt. %, 2.26 wt. %, 2.27 wt. %, 2.28 wt. %, 2.29 wt. %, 2.3 wt. %, 2.31 wt. %, 2.32 wt. %, 2.33 wt. %, 2.34 wt. %, 2.35 wt. %, 2.36 wt. %, 2.37 wt. %, 2.38 wt. %, 2.39 wt. %, 2.4 wt. %, 2.41 wt. %, 2.42 wt. %, 2.43 wt. %, 2.44 wt. %, 2.45 wt. %, 2.46 wt. %, 2.47 wt. %, 2.48 wt. %, 2.49 wt. %, 2.5 wt. %, 2.51 wt. %, 2.52 wt. %, 2.53 wt. %, 2.54 wt. %, 2.55 wt. %, 2.56 wt. %, 2.57 wt. %, 2.58 wt. %, 2.59 wt. %, 2.6 wt. %, 2.61 wt. %, 2.62 wt. %, 2.63 wt. %, 2.64 wt. %, 2.65 wt. %, 2.66 wt. %, 2.67 wt. %, 2.68 wt. %, 2.69 wt. %, 2.7 wt. %, 2.71 wt. %, 2.72 wt. %, 2.73 wt. %, 2.74 wt. %, 2.75 wt. %, 2.76 wt. %, 2.77 wt. %, 2.78 wt. %, 2.79 wt. %, 2.80 wt. %, 2.81 wt. %, or 2.82 wt. % Si.

In some examples, the alloy described herein also includes iron (Fe) in an amount of from about 0.06 wt. % to about 0.60 wt. % (e.g., from 0.13 wt. % to 0.30 wt. % or from 0.15 wt. % to 0.25 wt. %) based on the total weight of the alloy. For example, the alloy can include 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.2 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.3 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.4 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.5 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, or 0.6 wt. % Fe.

In some examples, the alloy described herein includes copper (Cu) in an amount of from about 0.26 wt. % to about 2.37 wt. % (e.g., from 0.52 wt. % to 1.18 wt. % or from 0.70 wt. % to 1.0 wt. %) based on the total weight of the alloy. For example, the alloy can include 0.26 wt. %, 0.27 wt. %, 0.28 wt. %, 0.29 wt. %, 0.3 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.4 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.5 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, 0.6 wt. %, 0.61 wt. %, 0.62 wt. %, 0.63 wt. %, 0.64 wt. %, 0.65 wt. %, 0.66 wt. %, 0.67 wt. %, 0.68 wt. %, 0.69 wt. %, 0.7 wt. %, 0.71 wt. %, 0.72 wt. %, 0.73 wt. %, 0.74 wt. %, 0.75 wt. %, 0.76 wt. %, 0.77 wt. %, 0.78 wt. %, 0.79 wt. %, 0.8 wt. %, 0.81 wt. %, 0.82 wt. %, 0.83 wt. %, 0.84 wt. %, 0.85 wt. %, 0.86 wt. %, 0.87 wt. %, 0.88 wt. %, 0.89 wt. %, 0.9 wt. %, 0.91 wt. %, 0.92 wt. %, 0.93 wt. %, 0.94 wt. %, 0.95 wt. %, 0.96 wt. %, 0.97 wt. %, 0.98 wt. %, 0.99 wt. %, 1.0 wt. %, 1.01 wt. %, 1.02 wt. %, 1.03 wt. %, 1.04 wt. %, 1.05 wt. %, 1.06 wt. %, 1.07 wt. %, 1.08 wt. %, 1.09 wt. %, 1.1 wt. %, 1.11 wt. %, 1.12 wt. %, 1.13 wt. %, 1.14 wt. %, 1.15 wt. %, 1.16 wt. %, 1.17 wt. %, 1.18 wt. %, 1.19 wt. %, 1.2 wt. %, 1.21 wt. %, 1.22 wt. %, 1.23 wt. %, 1.24 wt. %, 1.25 wt. %, 1.26 wt. %, 1.27 wt. %, 1.28 wt. %, 1.29 wt. %, 1.3 wt. %, 1.31 wt. %, 1.32 wt. %, 1.33 wt. %, 1.34 wt. %, 1.35 wt. %, 1.36 wt. %, 1.37 wt. %, 1.38 wt. %, 1.39 wt. %, 1.4 wt. %, 1.41 wt. %, 1.42 wt. %, 1.43 wt. %, 1.44 wt. %, 1.45 wt. %, 1.46 wt. %, 1.47 wt. %, 1.48 wt. %, 1.49 wt. %, 1.5 wt. %, 1.51 wt. %, 1.52 wt. %, 1.53 wt. %, 1.54 wt. %, 1.55 wt. %, 1.56 wt. %, 1.57 wt. %, 1.58 wt. %, 1.59 wt. %, 1.6 wt. %, 1.61 wt. %, 1.62 wt. %, 1.63 wt. %, 1.64 wt. %, 1.65 wt. %, 1.66 wt. %, 1.67 wt. %, 1.68 wt. %, 1.69 wt. %, 1.7 wt. %, 1.71 wt. %, 1.72 wt. %, 1.73 wt. %, 1.74 wt. %, 1.75 wt. %, 1.76 wt. %, 1.77 wt. %, 1.78 wt. %, 1.79 wt. %, 1.80 wt. %, 1.81 wt. %, 1.82 wt. %, 1.83 wt. %, 1.84 wt. %, 1.85 wt. %, 1.86 wt. %, 1.87 wt. %, 1.88 wt. %, 1.89 wt. %, 1.9 wt. %, 1.91 wt. %, 1.92 wt. %, 1.93 wt. %, 1.94 wt. %, 1.95 wt. %, 1.96 wt. %, 1.97 wt. %, 1.98 wt. %, 1.99 wt. %, 2.0 wt. %, 2.01 wt. %, 2.02 wt. %, 2.03 wt. %, 2.04 wt. %, 2.05 wt. %, 2.06 wt. %, 2.07 wt. %, 2.08 wt. %, 2.09 wt. %, 2.1 wt. % 2.11 wt. %, 2.12 wt. %, 2.13 wt. %, 2.14 wt. %, 2.15 wt. %, 2.16 wt. %, 2.17 wt. %, 2.18 wt. %, 2.19 wt. %, 2.2 wt. %, 2.21 wt. %, 2.22 wt. %, 2.23 wt. %, 2.24 wt. %, 2.25 wt. %, 2.26 wt. %, 2.27 wt. %, 2.28 wt. %, 2.29 wt. %, 2.3 wt. %, 2.31 wt. %, 2.32 wt. %, 2.33 wt. %, 2.34 wt. %, 2.35 wt. %, 2.36 wt. %, or 2.37 wt. % Cu.

In some examples, the alloy described herein can include manganese (Mn) in an amount of from about 0.06 wt. % to about 0.57 wt. % (e.g., from 0.12 wt. % to 0.28 wt. % or from 0.15 wt. % to 0.25 wt. %) based on the total weight of the alloy. For example, the alloy can include 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.2 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.3 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.4 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.5 wt. %, 0.51 wt. %, 0.52 wt. %, 0.53 wt. %, 0.54 wt. %, 0.55 wt. %, 0.56 wt. %, or 0.57 wt. % Mn.

In some examples, the alloy described herein can include magnesium (Mg) in an amount of from about 0.26 wt. % to about 2.37 wt. % (e.g., from 0.52 wt. % to 1.18 wt. % or from 0.70 wt. % to 0.90 wt. %) based on the total weight of the alloy. For example, the alloy can include 0.26 wt. %, 0.27 wt. %, 0.28 wt. %, 0.29 wt. %, 0.3 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.4 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.5 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, 0.6 wt. %, 0.61 wt. %, 0.62 wt. %, 0.63 wt. %, 0.64 wt. %, 0.65 wt. %, 0.66 wt. %, 0.67 wt. %, 0.68 wt. %, 0.69 wt. %, 0.7 wt. %, 0.71 wt. %, 0.72 wt. %, 0.73 wt. %, 0.74 wt. %, 0.75 wt. %, 0.76 wt. %, 0.77 wt. %, 0.78 wt. %, 0.79 wt. %, 0.8 wt. %, 0.81 wt. %, 0.82 wt. %, 0.83 wt. %, 0.84 wt. %, 0.85 wt. %, 0.86 wt. %, 0.87 wt. %, 0.88 wt. %, 0.89 wt. %, 0.9 wt. %, 0.91 wt. %, 0.92 wt. %, 0.93 wt. %, 0.94 wt. %, 0.95 wt. %, 0.96 wt. %, 0.97 wt. %, 0.98 wt. %, 0.99 wt. %, 1.0 wt. %, 1.01 wt. %, 1.02 wt. %, 1.03 wt. %, 1.04 wt. %, 1.05 wt. %, 1.06 wt. %, 1.07 wt. %, 1.08 wt. %, 1.09 wt. %, 1.1 wt. %, 1.11 wt. %, 1.12 wt. %, 1.13 wt. %, 1.14 wt. %, 1.15 wt. %, 1.16 wt. %, 1.17 wt. %, 1.18 wt. %, 1.19 wt. %, 1.2 wt. %, 1.21 wt. %, 1.22 wt. %, 1.23 wt. %, 1.24 wt. %, 1.25 wt. %, 1.26 wt. %, 1.27 wt. %, 1.28 wt. %, 1.29 wt. %, 1.3 wt. %, 1.31 wt. %, 1.32 wt. %, 1.33 wt. %, 1.34 wt. %, 1.35 wt. %, 1.36 wt. %, 1.37 wt. %, 1.38 wt. %, 1.39 wt. %, 1.4 wt. %, 1.41 wt. %, 1.42 wt. %, 1.43 wt. %, 1.44 wt. %, 1.45 wt. %, 1.46 wt. %, 1.47 wt. %, 1.48 wt. %, 1.49 wt. %, 1.5 wt. %, 1.51 wt. %, 1.52 wt. %, 1.53 wt. %, 1.54 wt. %, 1.55 wt. %, 1.56 wt. %, 1.57 wt. %, 1.58 wt. %, 1.59 wt. %, 1.6 wt. %, 1.61 wt. %, 1.62 wt. %, 1.63 wt. %, 1.64 wt. %, 1.65 wt. %, 1.66 wt. %, 1.67 wt. %, 1.68 wt. %, 1.69 wt. %, 1.7 wt. %, 1.71 wt. %, 1.72 wt. %, 1.73 wt. %, 1.74 wt. %, 1.75 wt. %, 1.76 wt. %, 1.77 wt. %, 1.78 wt. %, 1.79 wt. %, 1.80 wt. %, 1.81 wt. %, 1.82 wt. %, 1.83 wt. %, 1.84 wt. %, 1.85 wt. %, 1.86 wt. %, 1.87 wt. %, 1.88 wt. %, 1.89 wt. %, 1.9 wt. %, 1.91 wt. %, 1.92 wt. %, 1.93 wt. %, 1.94 wt. %, 1.95 wt. %, 1.96 wt. %, 1.97 wt. %, 1.98 wt. %, 1.99 wt. %, 2.0 wt. %, 2.01 wt. %, 2.02 wt. %, 2.03 wt. %, 2.04 wt. %, 2.05 wt. %, 2.06 wt. %, 2.07 wt. %, 2.08 wt. %, 2.09 wt. %, 2.1 wt. % 2.11 wt. %, 2.12 wt. %, 2.13 wt. %, 2.14 wt. %, 2.15 wt. %, 2.16 wt. %, 2.17 wt. %, 2.18 wt. %, 2.19 wt. %, 2.2 wt. %, 2.21 wt. %, 2.22 wt. %, 2.23 wt. %, 2.24 wt. %, 2.25 wt. %, 2.26 wt. %, 2.27 wt. %, 2.28 wt. %, 2.29 wt. %, 2.3 wt. %, 2.31 wt. %, 2.32 wt. %, 2.33 wt. %, 2.34 wt. %, 2.35 wt. %, 2.36 wt. %, or 2.37 wt. % Mg.

In some examples, the alloy described herein includes chromium (Cr) in an amount of up to about 0.20 wt. % (e.g., from about 0.02 wt. % to about 0.20 wt. %, from 0.04 wt. % to 0.10 wt. % or from 0.05 wt. % to 0.10 wt. %). For example, the alloy can include 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, or 0.2 wt. % Cr. In certain aspects, Cr is not present in the alloy (i.e., 0 wt. %).

In some examples, the alloy described herein includes zinc (Zn) in an amount of up to about 0.009 wt. % (e.g., from about 0.001 wt. % to about 0.009 wt. %, from 0.002 wt. % to 0.006 wt. % or from 0.002 wt. % to 0.004 wt. %) based on the total weight of the alloy. For example, the alloy can include 0.001 wt. %, 0.002 wt. %, 0.003 wt. %, 0.004 wt. %, 0.005 wt. %, 0.006 wt. %, 0.007 wt. %, 0.008 wt. %, or 0.009 wt. % Zn. In certain aspects, Zn is not present in the alloy (i.e., 0 wt. %).

In some examples, the alloy described herein includes titanium (Ti) in an amount of up to about 0.09% (e.g., from about 0.006 wt. % to about 0.09%, from 0.01 wt. % to 0.06 wt. % or from 0.01 wt. % to 0.03 wt. %) based on the total weight of the alloy. For example, the alloy can include 0.006 wt. %, 0.007 wt. %, 0.008 wt. %, 0.009 wt. %, 0.01 wt. %, 0.011 wt. %, 0.012 wt. %, 0.013 wt. %, 0.014 wt. %, 0.015 wt. %, 0.016 wt. %, 0.017 wt. %, 0.018 wt. %, 0.019 wt. %, 0.02 wt. %, 0.021 wt. %, 0.022 wt. %, 0.023 wt. %, 0.024 wt. %, 0.025 wt. %, 0.026 wt. %, 0.027 wt. %, 0.028 wt. %, 0.029 wt. %, 0.03 wt. %, 0.031 wt. %, 0.032 wt. %, 0.033 wt. %, 0.034 wt. %, 0.035 wt. %, 0.036 wt. %, 0.037 wt. %, 0.038 wt. %, 0.039 wt. %, 0.04 wt. %, 0.041 wt. %, 0.042 wt. %, 0.043 wt. %, 0.044 wt. %, 0.045 wt. %, 0.046 wt. %, 0.047 wt. %, 0.048 wt. %, 0.049 wt. %, 0.05 wt. %, 0.051 wt. %, 0.052 wt. %, 0.053 wt. %, 0.054 wt. %, 0.055 wt. %, 0.056 wt. %, 0.057 wt. %, 0.058 wt. %, 0.059 wt. %, 0.06 wt. %, 0.061 wt. %, 0.062 wt. %, 0.063 wt. %, 0.064 wt. %, 0.065 wt. %, 0.066 wt. %, 0.067 wt. %, 0.068 wt. %, 0.069 wt. %, 0.07 wt. %, 0.071 wt. %, 0.072 wt. %, 0.073 wt. %, 0.074 wt. %, 0.075 wt. %, 0.076 wt. %, 0.077 wt. %, 0.078 wt. %, 0.079 wt. %, 0.08 wt. %, 0.081 wt. %, 0.082 wt. %, 0.083 wt. %, 0.084 wt. %, 0.085 wt. %, 0.086 wt. %, 0.087 wt. %, 0.088 wt. %, 0.089 wt. %, 0.09 wt. % Ti. In certain aspects, Ti is not present in the alloy (i.e., 0 wt. %).

In some examples, the alloy described herein includes zirconium (Zr) in an amount of up to about 0.20% (e.g., from about 0.0003 wt. % to about 0.003%, from 0.0006 wt. % to 0.001 wt. % or from 0.0009 wt. % to 0.001 wt. %) based on the total weight of the alloy. For example, the alloy can include 0.0001 wt. %, 0.0002 wt. %, 0.0003 wt. %, 0.0004 wt. %, 0.0005 wt. %, 0.0006 wt. %, 0.0007 wt. %, 0.0008 wt. %, 0.0009 wt. %, 0.001 wt. %, 0.0011 wt. %, 0.0012 wt. %, 0.0013 wt. %, 0.0014 wt. %, 0.0015 wt. %, 0.0016 wt. %, 0.0017 wt. %, 0.0018 wt. %, 0.0019 wt. %, 0.002 wt. %, 0.0021 wt. %, 0.0022 wt. %, 0.0023 wt. %, 0.0024 wt. %, 0.0025 wt. %, 0.0026 wt. %, 0.0027 wt. %, 0.0028 wt. %, 0.0029 wt. %, 0.003 wt. %, 0.004 wt. %, 0.005 wt. %, 0.006 wt. %, 0.007 wt. %, 0.008 wt. %, 0.009 wt. %, 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, or 0.2 wt. % Zr. In certain aspects, Zr is not present in the alloy (i.e., 0 wt. %).

Optionally, the alloy compositions described herein can further include other minor elements, sometimes referred to as impurities, in amounts of 0.05 wt. % or below, 0.04 wt. % or below, 0.03 wt. % or below, 0.02 wt. % or below, or 0.01 wt. % or below each. These impurities may include, but are not limited to, V, Ni, Sn, Ga, Ca, or combinations thereof. Accordingly, V, Ni, Sn, Ga, or Ca may be present in alloys in amounts of 0.05 wt. % or below, 0.04 wt. % or below, 0.03 wt. % or below, 0.02 wt. % or below, or 0.01 wt. % or below. In some examples, the sum of all impurities does not exceed 0.15 wt. % (e.g., 0.10 wt. %). The remaining percentage of the alloy is aluminum.

In some examples, the aluminum alloy includes 0.79 wt. % Si, 0.20 wt. % Fe, 0.79 wt. % Cu, 0.196 wt. % Mn, 0.79 wt. % Mg, 0.07 wt. % Cr, 0.003 wt. % Zn, 0.02 wt. % Ti, 0.001 wt. % Zr and up to 0.15 wt. % of impurities, with the remainder Al.

In some examples, the aluminum alloy includes 0.94 wt. % Si, 0.20 wt. % Fe, 0.79 wt. % Cu, 0.196 wt. % Mn, 0.79 wt. % Mg, 0.07 wt. % Cr, 0.003 wt. % Zn, 0.03 wt. % Ti, 0.001 wt. % Zr and up to 0.15 wt. % of impurities, with the remainder Al.

Optionally, the aluminum alloy as described herein can be a 6xxx aluminum alloy according to one of the following aluminum alloy designations: AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, or AA6092.

Methods of Making

Methods of producing an aluminum sheet are also described herein. The aluminum alloy can be cast and then further processing steps may be performed. In some examples, the processing steps include a pre-heating and/or a homogenizing step, a hot rolling step, a solutionizing step, an optional quenching step, an artificial aging step, an optional coating step and an optional paint baking step.

In some examples, the method comprises casting a slab; hot rolling the slab to produce a hot rolled aluminum alloy in a form of a sheet, shate or plate; solutionizing the aluminum sheet, shate or plate; and aging the aluminum sheet, shate or plate. In some examples, the hot rolling step includes hot rolling the slab to a final gauge and/or a final temper. In some examples, a cold rolling step is eliminated (i.e., excluded). In some examples, the slabs are thermally quenched upon exit from the continuous caster. In some further examples, the slabs are coiled upon exit from the continuous caster. In some cases, the coiled slabs are cooled in air. In some instances, the method further includes pre-heating the coiled slabs. In some examples, the method further includes coating the aged aluminum sheet, shate or plate. In some further instances, the method further includes baking the coated aluminum sheet, shate or plate. The method steps are further described below.

Casting

The alloys described herein can be cast into slabs using a continuous casting (CC) process. The continuous casting device can be any suitable continuous casting device. The CC process can include, but is not limited to, the use of block casters, twin roll casters or twin belt casters. Surprisingly desirable results have been achieved using a twin belt casting device, such as the belt casting device described in U.S. Pat. No. 6,755,236 entitled "BELT-COOLING AND GUIDING MEANS FOR CONTINUOUS BELT CASTING OF METAL STRIP," the disclosure of which is hereby incorporated by reference in its entirety. In some examples, especially desirable results can be achieved by using a belt casting device having belts made from a metal having a high thermal conductivity, such as copper. The belt casting device can include belts made from a metal having a thermal conductivity of up to 400 Watts per meter Kelvin (W/m·K). For example, the thermal conductivity of the belts can be 50 W/m·K, 100 W/m·K, 150 W/m·K, 250 W/m·K, 300 W/m·K, 350 W/m·K, or 400 W/m·K at casting temperatures, although metals having other values of thermal conductivity may be used, including carbon-steel, or low-carbon steel. The CC can be performed at rates up to about 12 meters/minute (m/min). For example, the CC can be performed at a rate of 12 m/min or less, 11 m/min or less, 10 m/min or less, 9 m/min or less, 8 m/min or less, 7 m/min or less, 6 m/min or less, 5 m/min or less, 4 m/min or less, 3 m/min or less, 2 m/min or less, or 1 m/min or less.

Quenching

The resulting slabs can optionally be thermally quenched upon exit from the continuous caster. In some examples, the quench is performed with water. Optionally, the water quenching step can be performed at a rate of up to about 200° C./s (for example, from 10° C./s to 190° C./s, from 25° C./s to 175° C./s, from 50° C./s to 150° C./s, from 75° C./s to 125° C./s, or from 10° C./s to 50° C./s). The water temperature can be from about 20° C. to about 75° C. (e.g., about 25° C., about 30° C., about 35° C., about 40° C., about 45° C., about 50° C., about 55° C., about 60° C., about 65° C., about 70° C., or about 75° C.). Optionally, an air cooling step can be performed at a rate of from about 1° C./s to about 300° C./day. The resulting slab can have a thickness of from about 5 mm to about 50 mm (e.g., from about 10 mm to about 45 mm, from about 15 mm to about 40 mm, or from about 20 mm to about 35 mm), such as about 10 mm. For example, the resulting slab can be 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, 40 mm, 41 mm, 42 mm, 43 mm, 44 mm, 45 mm, 46 mm, 47 mm, 48 mm, 49 mm, or 50 mm thick.

In some examples, water quenching the slab upon exit from the continuous caster results in an aluminum alloy slab in a T4-temper. After the optional water quenching, the slab in T4-temper can then be optionally coiled into an intermediate coil and stored for a time period of up to 90 days. Unexpectedly, water quenching the slab upon exit from the continuous caster does not resulting in the slab cracking as determined by visual inspection such that the slab can be devoid of cracks. For example, as compared to direct chill cast ingots, the cracking tendency of the slabs produced according to the methods described herein is significantly diminished. In some examples, there are about 8 or fewer cracks per square meter having a length less than about 8.0 mm (e.g., about 7 or fewer cracks, about 6 or fewer cracks, about 5 or fewer cracks, about 4 or fewer cracks, about 3 or fewer cracks, about 2 or fewer cracks, or about 1 crack per square meter).

Coiling

Optionally, the slab can be coiled into an intermediate coil upon exit from the continuous caster. In some examples, the slab is coiled into an intermediate coil upon exit from the continuous caster resulting in F-temper. In some further examples, the coil is cooled in air. In some still further examples, the air cooled coil is stored for a period of time. In some examples, the intermediate coils are maintained at a temperature of from about 100° C. to about 350° C. (for example, about 200° C. or about 300° C.). In some further examples, the intermediate coils are maintained in cold storage to prevent natural aging resulting in F-temper.

Pre-Heating and/or Homogenizing

When stored, the intermediate coils can be optionally reheated in a pre-heating step. In some examples, the reheating step can include pre-heating the intermediate coils for a hot rolling step. In some further examples, the reheating step can include pre-heating the intermediate coils at a rate of up to about 100° C./h (for example, about 10° C./h or about 50° C./h). The intermediate coils can be heated to a temperature of about 350° C. to about 580° C. (e.g., about 375° C. to about 570° C., about 400° C. to about 550° C., about 425° C. to about 500° C., or about 500° C. to about 580° C.). The intermediate coils can soak for about 1 minute to about 120 minutes, preferably about 60 minutes.

Optionally, the intermediate coils after storage and/or pre-heating of the coils or the slab upon exit from the caster can be homogenized. The homogenization step can include heating the slab or intermediate coil to attain a peak metal temperature (PMT) of about, or at least about, 450° C. (e.g., at least 460° C., at least 470° C., at least 480° C., at least 490° C., at least 500° C., at least 510° C., at least 520° C., at least 530° C., at least 540° C., at least 550° C., at least 560° C., at least 570° C., or at least 580° C.). For example, the coil or slab can be heated to a temperature of from about 450° C. to about 580° C., from about 460° C. to about 575° C., from about 470° C. to about 570° C., from about 480° C. to about 565° C., from about 490° C. to about 555° C., or from about 500° C. to about 550° C. In some cases, the heating rate to the PMT can be about 100° C./hour or less, 75° C./hour or less, 50° C./hour or less, 40° C./hour or less, 30° C./hour or less, 25° C./hour or less, 20° C./hour or less, or 15° C./hour or less. In other cases, the heating rate to the PMT can be from about 10° C./min to about 100° C./min (e.g., from about 10° C./min to about 90° C./min, from about 10° C./min to about 70° C./min, from about 10° C./min to about 60° C./min, from about 20° C./min to about 90° C./min, from about 30° C./min to about 80° C./min, from about 40° C./min to about 70° C./min, or from about 50° C./min to about 60° C./min).

The coil or slab is then allowed to soak (i.e., held at the indicated temperature) for a period of time. According to one non-limiting example, the coil or slab is allowed to soak for up to about 36 hours (e.g., from about 30 minutes to about 36 hours, inclusively). For example, the coil or slab can be soaked at a temperature for 10 seconds, 15 seconds, 30 seconds, 45 seconds, 1 minute, 2 minutes, 5 minutes, 10 minutes, 15 minutes, 20 minutes, 25 minutes, 30 minutes, 1 hour, 2 hours, 3 hours, 4 hours, 5 hours, 6 hours, 7 hours, 8 hours, 9 hours, 10 hours, 11 hours, 12 hours, 13 hours, 14 hours, 15 hours, 16 hours, 17 hours, 18 hours, 19 hours, 20 hours, 21 hours, 22 hours, 23 hours, 24 hours, 25 hours, 26 hours, 27 hours, 28 hours, 29 hours, 30 hours, 31 hours, 32 hours, 33 hours, 34 hours, 35 hours, 36 hours, or anywhere in between.

Hot Rolling

Following the pre-heating and/or homogenizing step, a hot rolling step can be performed. The hot rolling step can include a hot reversing mill operation and/or a hot tandem mill operation. The hot rolling step can be performed at a temperature ranging from about 250° C. to about 500° C. (e.g., from about 300° C. to about 400° C. or from about 350° C. to about 500° C.). For example, the hot rolling step can be performed at a temperature of about 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., 450° C., 460° C., 470° C., 480° C., 490° C., or 500° C.

In the hot rolling step, the metal product can be hot rolled to a thickness of a 10 mm gauge or less (e.g., from about 2 mm to about 8 mm). For example, the metal product can be hot rolled to about a 10 mm gauge or less, a 9 mm gauge or less, an 8 mm gauge or less, a 7 mm gauge or less, a 6 mm gauge or less, a 5 mm gauge or less, a 4 mm gauge or less, a 3 mm gauge or less, or a 2 mm gauge or less. In some cases, the percentage reduction in thickness resulting from the hot rolling step can be from about 35% to about 80% (e.g., 35%, 40%, 45%, 50%, 55%, 60%, 65%, 70%, 75%, or 80%). Optionally, the hot rolled metal product is quenched at the end of the hot rolling step (e.g., upon exit from the tandem mill). Optionally, at the end of the hot rolling step, the hot rolled metal product is coiled.

Optionally, the hot rolled metal is provided in a final gauge and/or a final temper. In some non-limiting examples, the hot rolling step can provide a final product having desired mechanical properties such that further downstream processing is not required. For example, the final product can be hot rolled and delivered in a final gauge and temper without any cold rolling, solutionizing, quenching after solutionizing, natural aging, and/or artificial aging. Hot rolling to final gauge and temper, also referred to as "HRTGT", can provide a metal product having optimized mechanical properties at a significantly reduced cost.

Optionally, further processing steps, such as cold rolling, warm rolling, solutionizing, quenching after solutionizing, and/or aging, can be performed. These steps are further described below.

Cold Rolling-Optional

Optionally, the hot rolled metal product can be cold rolled. For example, an aluminum alloy plate or shate can be cold rolled to an about 0.1 mm to about 4 mm thick gauge (e.g., from about 0.5 mm to about 3 mm thick gauge), which is referred to as a sheet. For example, the cast aluminum alloy product can be cold rolled to a thickness of less than about 4 mm. For example, a sheet may have a thickness of less than 4 mm, less than 3 mm, less than 2 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm. The temper of the as-rolled sheets is referred to as F-temper.

Optionally, a cold rolling step is eliminated. In some examples, the cold rolling step can increase the strength and hardness of an aluminum alloy while concomitantly decreasing the formability of the aluminum alloy sheet, shate or plate. Eliminating the cold rolling step can preserve the ductility of the aluminum alloy sheet, shate or plate. Unexpectedly, eliminating the cold rolling step does not have an adverse effect on the strength of the aluminum alloys described herein, as will be described in detail in the following examples.

Warm Rolling

Optionally, the hot rolled metal product can be warm rolled to final gauge. The warm rolling step can be performed at a temperature less than the hot rolling temperature. Optionally, the warm rolling temperature can be from about 300° C. to about 400° C. (e.g., 300° C., 310° C., 320° C., 330° C., 340° C., 350° C., 360° C., 370° C., 380° C., 390° C., 400° C., or anywhere in between). In some cases, the hot rolled product can be warm rolled to an about 0.1 mm to about 4 mm thick gauge (e.g., from about 0.5 mm to about 3 mm thick gauge), which is referred to as a sheet. For example, the cast aluminum alloy product can be warm rolled to a thickness of less than about 4 mm. For example, a sheet may have a thickness of less than 4 mm, less than 3 mm, less than 2 mm, less than 1 mm, less than 0.9 mm, less than 0.8 mm, less than 0.7 mm, less than 0.6 mm, less than 0.5 mm, less than 0.4 mm, less than 0.3 mm, less than 0.2 mm, or less than 0.1 mm.

A quenching step, as described herein, can be performed before the warm rolling step, after the warm rolling step, or before and after the warm rolling step. Optionally, the hot rolled product can be coiled and/or stored prior to the warm rolling step. In these cases, the coiled and/or stored hot rolled product can be reheated in a pre-heating step as described above.

Solutionizing

The hot rolled metal product or cold rolled metal product can then undergo a solutionizing step. The solutionizing step can be performed at a temperature ranging from about 420° C. to about 560° C. (e.g., from about 480° C. to about 550° C. or from about 500° C. to about 530° C.). The solutionizing step can be performed for about 0 minutes to about 1 hours (e.g., for about 1 minute or for about 30 minutes). Optionally, at the end of the solutionizing step (e.g., upon exit from a furnace), the sheet is subjected to a thermal quenching step. The thermal quenching step can be performed using air and/or water. The water temperature can be from about 20° C. to about 75° C. (e.g., about 25° C., about 30° C., about 35° C., about 40° C., about 45° C., about 50° C., about 55° C., about 60° C., about 65° C., about 70° C., or about 75° C.).

Aging

Optionally, the metal product is subjected to an artificial aging step. The artificial aging step develops the high strength property of the alloys and optimizes other desirable properties in the alloys. The mechanical properties of the final product can be controlled by various aging conditions depending on the desired use. In some cases, the metal product described herein can be delivered to customers in a Tx temper (for example, a T1 temper, a T4 temper, a T5 temper, a T6 temper, a T7 temper, a T81 temper, or a T82 temper, for example), a W temper, an O temper, or an F temper. In some examples, an artificial aging step can be performed. The artificial aging step can be performed at a temperature from about 100° C. to about 250° C. (e.g., at about 180° C. or at about 225° C.). The aging step can be performed for a period of time from about 10 minutes to about 36 hours (e.g., for about 30 minutes or for about 24 hours). In some examples, the artificial aging step can be performed at 180° C. for 30 minutes to result in a T81-temper. In some examples, the artificial aging step can be performed at 185° C. for 25 minutes to result in a T81-temper. In some further examples, the artificial aging step can be performed at 225° C. for 30 minutes to result in a T82-temper. In some still further examples, the alloys are subjected to a natural aging step. The natural aging step can result in a T4-temper.

Coating and/or Paint Baking

Optionally, the metal product is subjected to a coating step. Optionally, the coating step can include zinc phosphating (Zn-phosphating) and/or electrocoating (E-coating). The Zn-phosphating and E-coating can be performed according to standards commonly used in the aluminum industry as known to one of skill in the art. Optionally, the coating step can be followed by a paint baking step. The paint baking step can be performed at a temperature of from about 150° C. to about 230° C. (e.g., at about 180° C. or at about 210° C.). The paint baking step can be performed for a time period of about 10 minutes to about 60 minutes (e.g., about 30 minutes or about 45 minutes).

Exemplary Methods

Figure 1B:
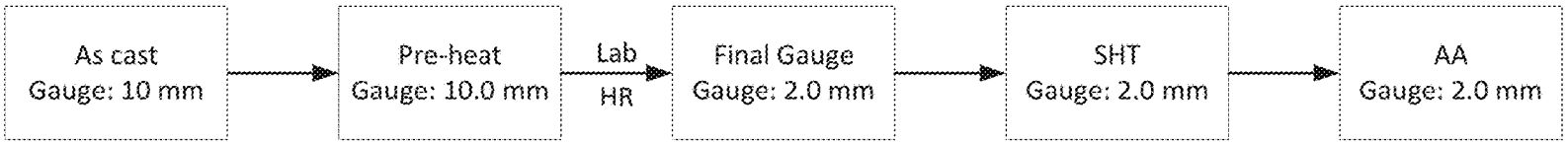

FIG. 1B depicts one exemplary method. The aluminum alloy is continuously cast into the form of a slab (e.g., an aluminum alloy having a thickness of about 5 mm to about 50 mm, preferably about 10 mm) from a twin belt caster. In some examples, upon exiting the continuous caster, the slab can optionally be quenched with water and the resulting quenched slab can be coiled and stored for a period of up to 90 days. In a further example, upon exiting the continuous caster, the slab can be optionally coiled and the resulting coil can be cooled in air. The resulting cooled coil can be stored for a period of time. In some cases, the slab can be subjected to further processing steps. In some examples, the coil can be optionally preheated and/or homogenized. The resulting optionally preheated and/or homogenized coil can be uncoiled. The uncoiled slab can be hot rolled to an aluminum alloy product of a final gauge. The aluminum alloy product of final gauge can be a plate, sheet or shate. The resulting aluminum alloy product can be optionally solutionized (SHT). The resulting solutionized aluminum alloy product can be optionally quenched. The resulting solutionized and/or quenched aluminum alloy product can be optionally subjected to an aging step. The aging step can include natural and/or artificial aging (AA).

Figure 9:
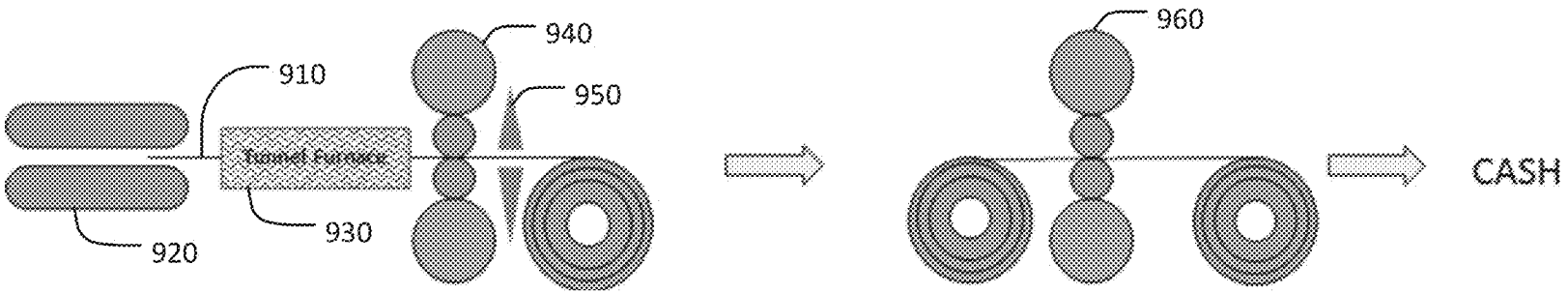
FIG. 9 is a schematic depicting a method of producing aluminum alloy articles according to certain aspects of the present disclosure. The aluminum alloys are continuously cast into the form of a slab, homogenized, hot rolled, quenched, coiled, cold rolled, solutionized and/or quenched.

FIG. 9 depicts another exemplary method. The aluminum alloy is continuously cast into the form of a slab, homogenized, hot rolled to produce a hot rolled aluminum alloy having an intermediate gauge (i.e., an intermediate gauge aluminum alloy article), quenched, and coiled. The coiled material, optionally after a period of time, is then cold rolled to provide a final gauge aluminum alloy product. The resulting aluminum alloy product can be optionally solutionized and/or quenched. The resulting quenched and/or solutionized aluminum alloy product can be optionally subjected to an aging step. The aging step can include natural and/or artificial aging (AA).

Figure 11:
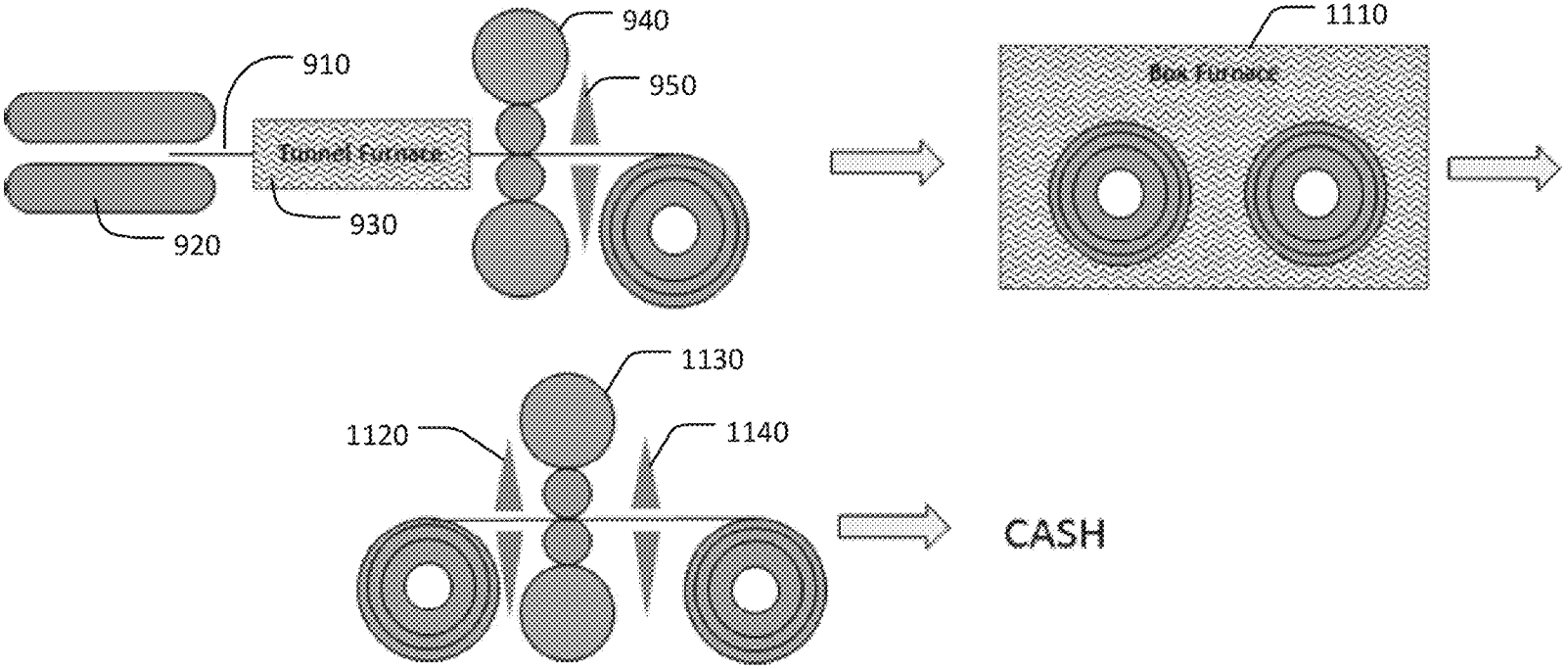
FIG. 11 is a schematic depicting a method of producing aluminum alloy articles according to certain aspects of the present disclosure. The aluminum alloys are continuously cast into the form of a slab, homogenized, hot rolled, quenched, coiled, preheated, quenched to a temperature lower than the preheating temperature, warm rolled, and solutionized.

FIG. 11 depicts another production method as described herein. The aluminum alloy is continuously cast into the form of a slab, homogenized, hot rolled to produce a hot rolled aluminum alloy having an intermediate gauge (i.e., an intermediate gauge aluminum alloy article), quenched, and coiled. The coiled material, optionally after a period of time, is then preheated, quenched to a temperature lower than the preheating temperature, and warm rolled to provide a final gauge aluminum alloy product. The resulting aluminum alloy product can be optionally quenched and/or solutionized. The resulting quenched and/or solutionized aluminum alloy product can be optionally subjected to an aging step. The aging step can include natural and/or artificial aging (AA).

Figure 13:
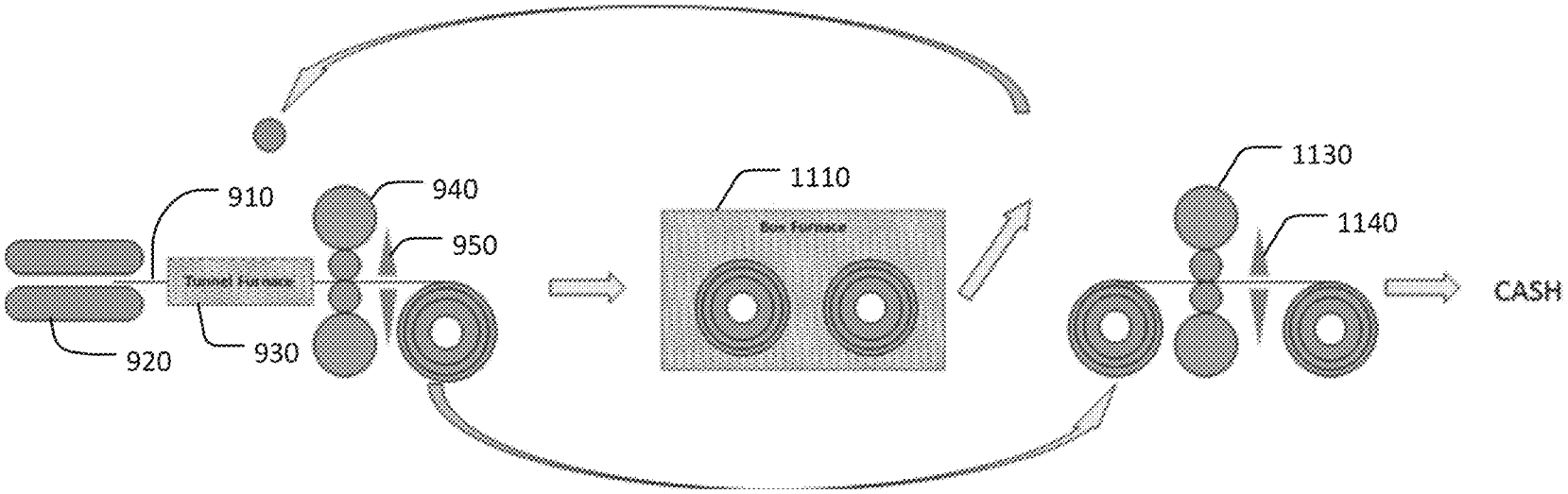
FIG. 13 is a schematic depicting a method of producing aluminum alloy articles according to certain aspects of the present disclosure. The aluminum alloys are continuously cast into the form of a slab, homogenized, hot rolled, quenched, coiled, preheated, hot rolled, quenched, cold rolled, and solutionized.

FIG. 13 depicts an exemplary production method as described herein. The aluminum alloy is continuously cast into the form of a slab, homogenized, hot rolled to produce a hot rolled aluminum alloy having a first intermediate gauge (i.e., a first intermediate gauge aluminum alloy article), quenched, and coiled. The coiled material, optionally after a period of time, is then preheated, hot rolled to produce a hot rolled aluminum alloy having a second intermediate gauge (i.e., a second intermediate gauge aluminum alloy article), quenched, and cold rolled to provide a final gauge aluminum alloy product. The resulting aluminum alloy product can be optionally quenched and/or solutionized. The resulting quenched and/or solutionized aluminum alloy product can be optionally subjected to an aging step. The aging step can include natural and/or artificial aging (AA).

Figure 15:
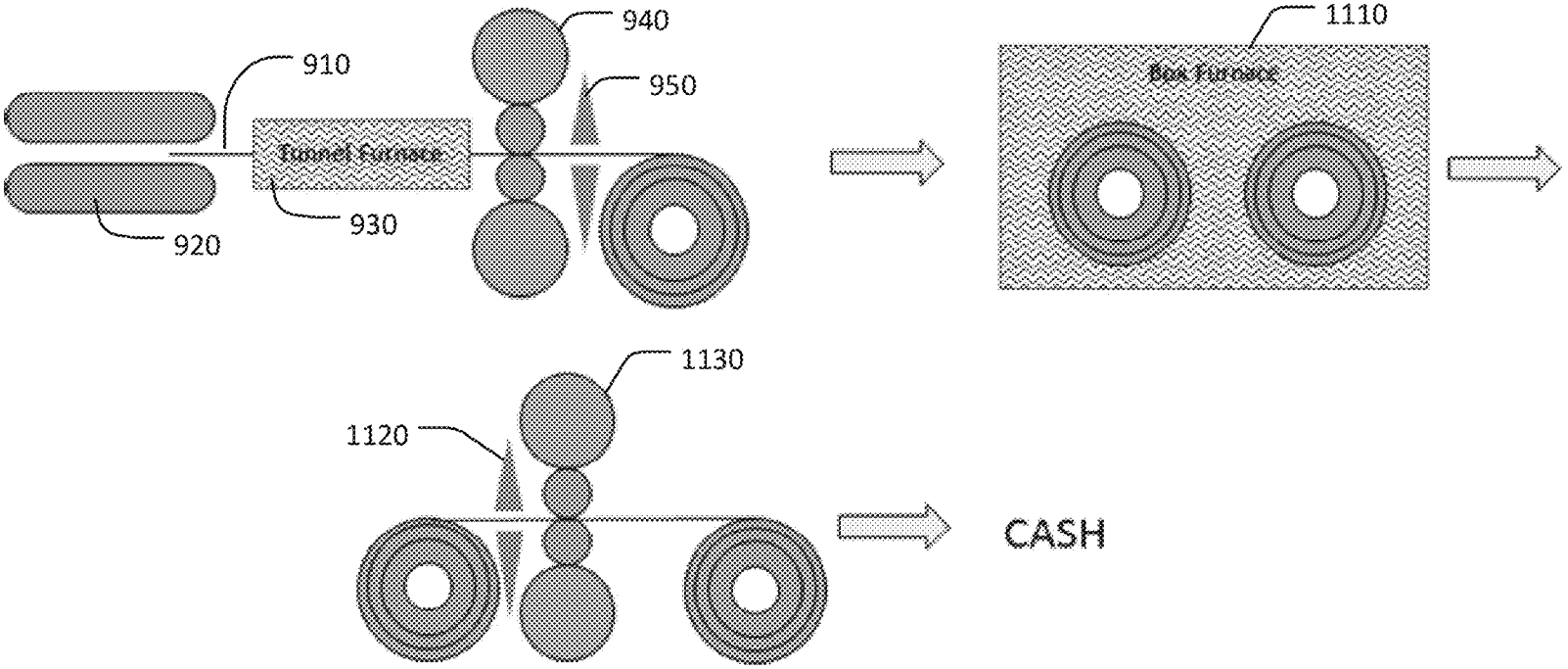
FIG. 15 is a schematic depicting a method of producing aluminum alloy articles according to certain aspects of the present disclosure. The aluminum alloys are continuously cast into the form of a slab, homogenized, hot rolled, quenched, pre-heated, quenched, cold rolled, and solutionized.

FIG. 15 depicts an exemplary production method as described herein. The aluminum alloy is continuously cast into the form of a slab, homogenized, hot rolled, quenched, pre-heated, quenched, and cold rolled to provide a final gauge aluminum alloy product. The resulting aluminum alloy product can be optionally quenched and/or solutionized. The resulting quenched and/or solutionized aluminum alloy product can be optionally subjected to an aging step. The aging step can include natural and/or artificial aging (AA).

Properties

The resulting metal product as described herein has a combination of desired properties, including high strength and high formability under a variety of temper conditions, including Tx-temper conditions (where Tx tempers can include T1, T4, T5, T6, T7, T81 or T82 tempers), W temper, O temper, or F temper. In some examples, the resulting metal product has a yield strength of between approximately 150-500 MPa (e.g., from 300 MPa to 500 MPa, from 350 MPa to 475 MPa, or from 374 MPa to 460 MPa). For example, the yield strength can be approximately 150 MPa, 160 MPa, 170 MPa, 180 MPa, 190 MPa, 200 MPa, 210 MPa, 220 MPa, 230 MPa, 240 MPa, 250 MPa, 260 MPa, 270 MPa, 280 MPa, 290 MPa, 300 MPa, 310 MPa, 320 MPa, 330 MPa, 340 MPa, 350 MPa, 360 MPa, 370 MPa, 380 MPa, 390 MPa, 400 MPa, 410 MPa, 420 MPa, 430 MPa, 440 MPa, 450 MPa, 460 MPa, 470 MPa, 480 MPa, 490 MPa, or 500 MPa. Optionally, the metal product having a yield strength of between 150-500 MPa can be in the T4, T81, or T82 temper.

In some examples, the resulting metal product has a bend angle of between approximately 35° and 130°. For example, the bend angle of the resulting metal product can be approximately 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, 90°, 91°, 92°, 93°, 94°, 95°, 96°, 97°, 98°, 99°, 100°, 101°, 102°, 103°, 104°, 105°, 106°, 107°, 108°, 109°, 110°, 111°, 112°, 113°, 114°, 115°, 116°, 117°, 118°, 119°, 120°, 121°, 122°, 123°, 124°, 125°, 126°, 127°, 128°, 129°, or 130°. Optionally, the metal product having a bend angle of between 40° and 130° can be in the T4, T81, or T82 temper. In some examples, the metal product has an interior bend angle of from about 35° to about 65° when in a T4 temper. In other examples, the metal product has an interior bend angle of from about 110° to about 130° when in a T82 temper. Optionally, in a semi-crash application, the aluminum alloy product includes an interior bend angle of from about 90° to about 130° and from about 100° to about 130° when in a T82 temper.

Methods of Use

The alloys and methods described herein can be used in automotive and/or transportation applications, including motor vehicle, aircraft, and railway applications, or any other desired application. In some examples, the alloys and methods can be used to prepare motor vehicle body part products, such as bumpers, inner panels, outer panels, side panels, inner hoods, outer hoods, or trunk lid panels. The aluminum alloys and methods described herein can also be used in aircraft or railway vehicle applications, to prepare, for example, external and internal panels.

The alloys and methods described herein can also be used in electronics applications. For example, the alloys and methods described herein can be used to prepare housings for electronic devices, including mobile phones and tablet computers. In some examples, the alloys can be used to prepare housings for the outer casing of mobile phones (e.g., smart phones) and tablet bottom chassis.

In some cases, the alloys and methods described herein can be used in industrial applications. For example, the alloys and methods described herein can be used to prepare products for the general distribution market.

Reference has been made in detail to various examples of the disclosed subject matter, one or more examples of which were set forth above. Each example was provided by way of explanation of the subject matter, not limitation thereof. In fact, it will be apparent to those skilled in the art that various modifications and variations may be made in the present subject matter without departing from the scope or spirit of the disclosure. For instance, features illustrated or described as part of one embodiment may be used with another embodiment to yield a still further embodiment.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention.

EXAMPLES

Example 1

Various alloys were prepared for strength, elongation, and formability testing. The chemical compositions for these alloys are provided in Table 5 below.

TABLE 5

| Element | Alloy A | Alloy B | Alloy C |
|---|---|---|---|
| Si | 0.79 | 0.94 | 1.27 |
| Fe | 0.2 | 0.2 | 0.14 |
| Cu | 0.79 | 0.79 | 0.67 |
| Mn | 0.19 | 0.19 | 0.09 |
| Mg | 0.79 | 0.79 | 1.17 |
| Cr | 0.07 | 0.07 | 0.08 |
| Zn | 0.003 | 0.003 | 0.003 |
| Ti | 0.02 | 0.03 | 0.02 |
| Zr | 0.001 | 0.001 | 0.1 |
| Impurities | 0.05 (each)<br>0.15 (total) | 0.05 (each)<br>0.15 (total) | 0.05 (each)<br>0.15 (total) |
| Al | Remainder | Remainder | Remainder |

All values expressed as weight percentage (wt. %) of the whole.

Alloys A and B (exemplary alloys) were continuously cast using an exemplary method described herein. Specifically, a twin belt caster was used to produce a continuously cast aluminum alloy slab. Alloys A and B were each processed via an exemplary processing route (A-HRTG and B-HRTG) according to FIG. 1B and a comparative processing route (A-HR+WQ+CR and B-HR+WQ+CR) according to FIG. 1A. Alloy C (a comparative alloy) was cast using a laboratory scale DC caster according to methods known to a person of ordinary skill in the art and was then processed by the comparative route (C-HR+WQ+CR) according to FIG. 1A. The processing routes as described in FIGS. 1A and 1B are described below.

FIG. 1A is a process flow chart describing the comparative processing route. The comparative route (referred to as "HR+WQ+CR") included a traditional slow preheating and homogenizing step (Pre-heat) followed by hot rolling (HR), coiling/water quenching (Reroll), cold rolling (CR) to a final gauge (Final Gauge, solutionizing (SHT) and artificial aging (AA) to obtain T8x-temper properties or natural aging (not shown) to obtain T4-temper properties. FIG. 1B is a process flow chart describing an exemplary processing route according to methods described herein. The exemplary route (referred to as "HRTG") included preheating and homogenizing the slab (Pre-heat) and hot rolling (HR) to a final gauge (Final Gauge) followed by coiling, solutionizing (SHT), optional quenching and optional artificial aging (AA) to obtain T8x-temper properties or natural aging (not shown) to obtain T4-temper properties.

Figure 2:
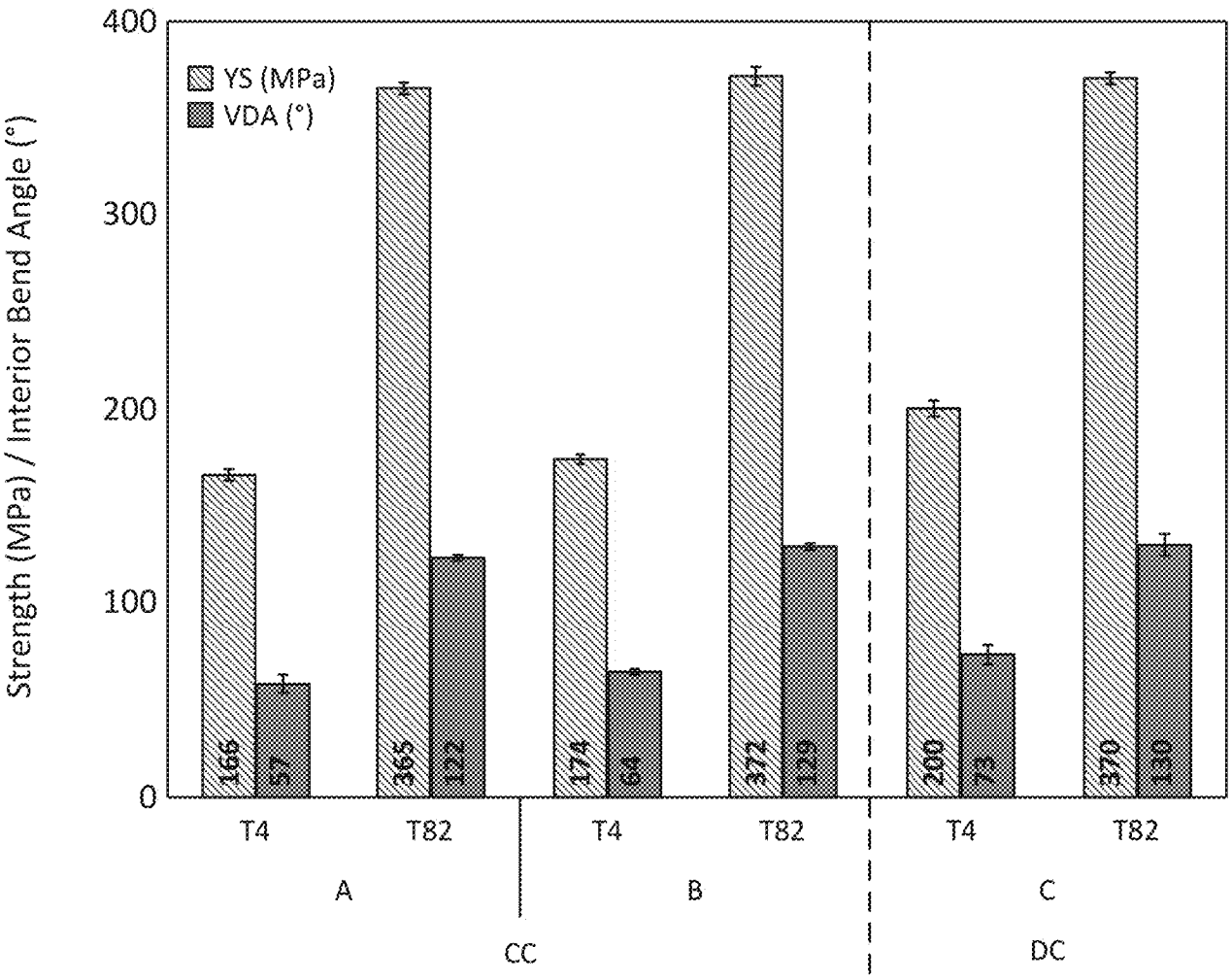
FIG. 2 is a graph showing the yield strength (left hatch filled histogram bar of each pair) and the bend angle (right cross-hatch filled histogram bar of each pair) of continuously cast (referred to as "CC") exemplary alloys (A, B) processed by an exemplary route (hot roll to gauge, referred to as "HRTG," See FIG. 1B) and a DC cast (referred to as "DC") comparative alloy (C) processed by a comparative route (hot rolled and cold rolled, referred to as "HR+WQ+CR", See FIG. 1A). Measurements were taken in the long transverse direction relative to the rolling direction.

The mechanical properties were determined under the ASTM B557 2" GL standard for tensile testing. Formability was determined under Verband der Automobilindustrie (VDA) standards for a 3-point bend test without pre-straining the samples. FIG. 2 is a graph showing the yield strength (YS, filled histogram) and bend angle (VDA, hatched histogram) of each alloy (A, B, and C) tested in the long transverse (L) orientation relative to the rolling direction. A comparison of tensile strength and bending properties for continuously cast alloys A and B, and DC cast alloy C, each after natural aging (T4 temper) and after artificial aging (T82 temper aging), is shown in FIG. 2. In FIG. 2, "CC" refers to continuous casting and "DC" refers to direct chill casting.

As shown in FIG. 2, the continuously cast exemplary alloys A and B processed by the exemplary HRTG route can provide similar tensile strength results (YS ~370 MPa) with improved bending angles (ca. 10-15° lower) when compared to the DC cast comparative alloy C processed by the comparative HR+WQ+CR route. A lower bend angle is indicative of higher formability.

Figure 3:
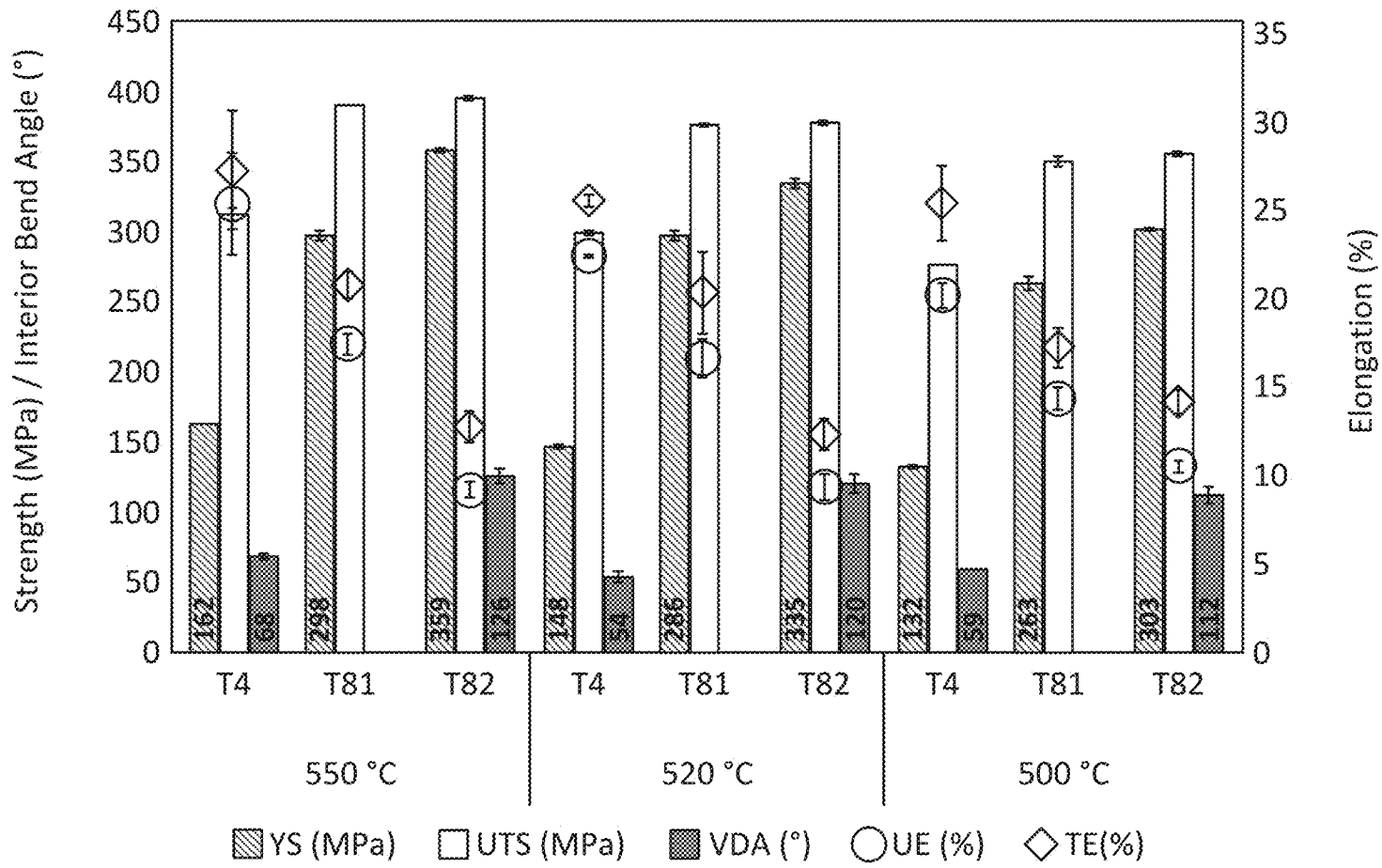
FIG. 3 is a graph showing the tensile properties of continuously cast exemplary alloy A processed by the route described in FIG. 1A ("HR+WQ+CR") using three different solutionizing temperatures and in the T4, T81, and T82 tempers. The left histogram bar in each set represents the yield strength ("YS") of the alloy made according to different methods of making. The center histogram bar in each set represents the ultimate tensile strength ("UTS") of the alloy made according to different methods of making. The right histogram bar in each set represents the bend angle ("VDA") of the alloy made according to different methods of making. Elongation is represented by unfilled point markers. The diamond in each set represents the total elongation ("TE") of the alloy made according to different methods of making, and the circle in each set represents the uniform elongation ("UE") of the alloy made according to different methods of making.
Figure 4:
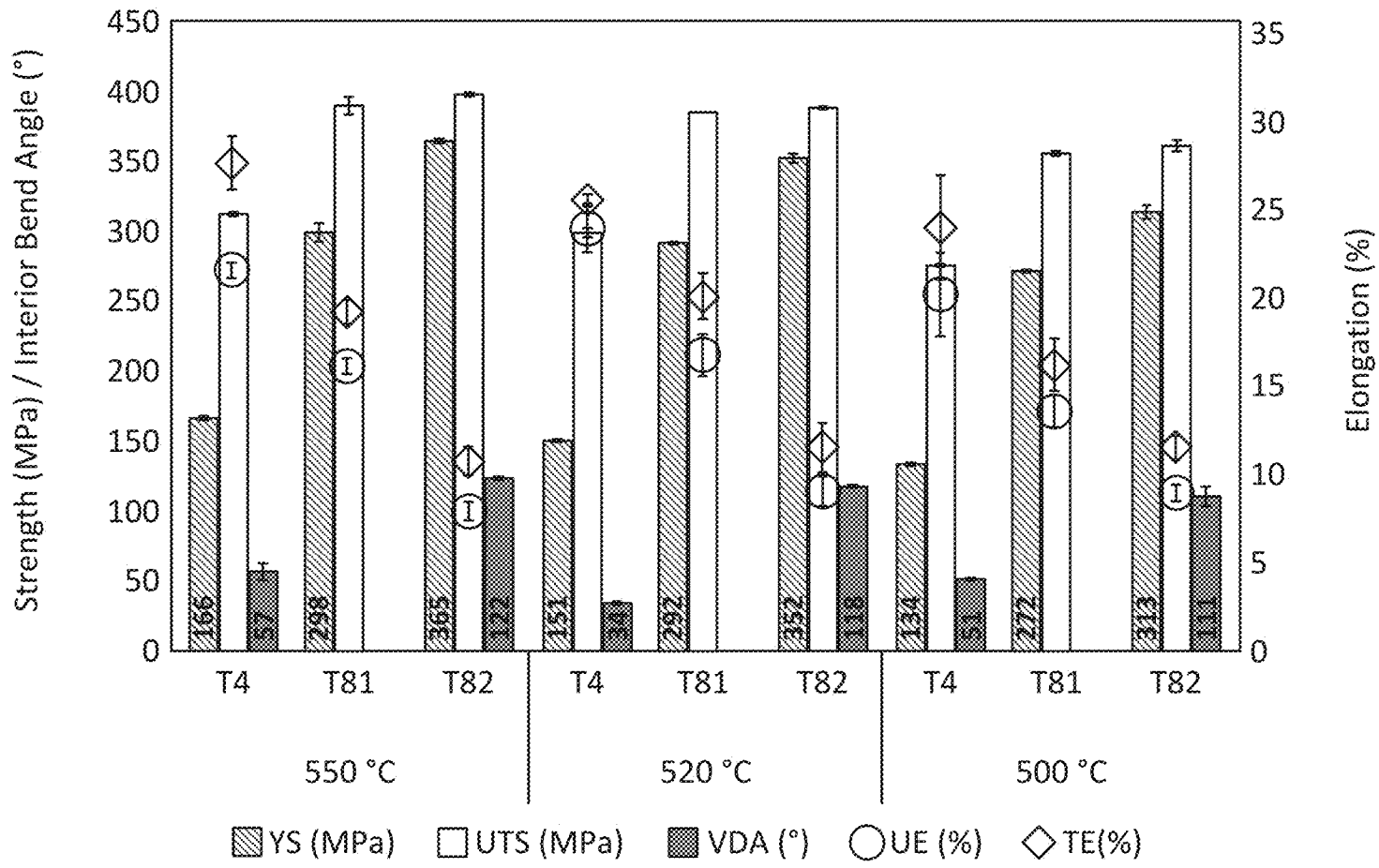
FIG. 4 is a graph showing the tensile properties of continuously cast exemplary alloy A processed by the route described in FIG. 1B ("HRTG") using three different solutionizing temperatures as indicated in the graph and in the T4, T81, and T82 tempers. The left histogram bar in each set represents the yield strength of the alloy made according to different methods of making. The center histogram bar in each set represents the ultimate tensile strength of the alloy made according to different methods of making. The right histogram bar in each set represents the bend angle of the alloy made according to different methods of making. Elongation is represented by unfilled point markers. The diamond in each set represents the total elongation of the alloy made according to different methods of making, and the circle in each set represents the uniform elongation of the alloy made according to different methods of making.

The mechanical properties for exemplary alloy A are shown in FIGS. 3 and 4. FIG. 3 presents the mechanical properties of the continuously cast exemplary alloy A obtained from process route HR+WQ+CR. FIG. 4 presents the mechanical properties of the continuously cast exemplary alloy A obtained from process route HRTG. Yield strength (YS) (left histogram, hatch filled), ultimate tensile strength (UTS) (center histogram, cross-hatch filled), and bend angle (VDA) (right histogram, vertical line filled) are represented by histograms and uniform elongation (UE) (unfilled circle) and total elongation (TE) (unfilled diamond) are represented by unfilled point markers. The alloys were tested after natural aging (T4) and after artificial aging (T81 and T82) steps as described herein. Similar tensile strengths were obtained from both processing routes, whereas the HRTG route provided a 10-15° lower bending angle compared to a more traditional HR+WQ+CR route. Solutionizing (SHT) at 550° C. (peak metal temperature, PMT) without soaking provided the highest bendability for the exemplary and comparative aluminum alloys in the T4-temper condition, and the highest strength (~365 MPa) for the exemplary and comparative alloys in the T82-temper condition. Strength decreased and bending improved for samples solutionized at lower PMT's (520° C. and 500° C.). However, a high YS of about 350 MPa can be achieved for continuously cast 6xxx alloys when solutionized at 520° C. without soaking.

Figure 5:
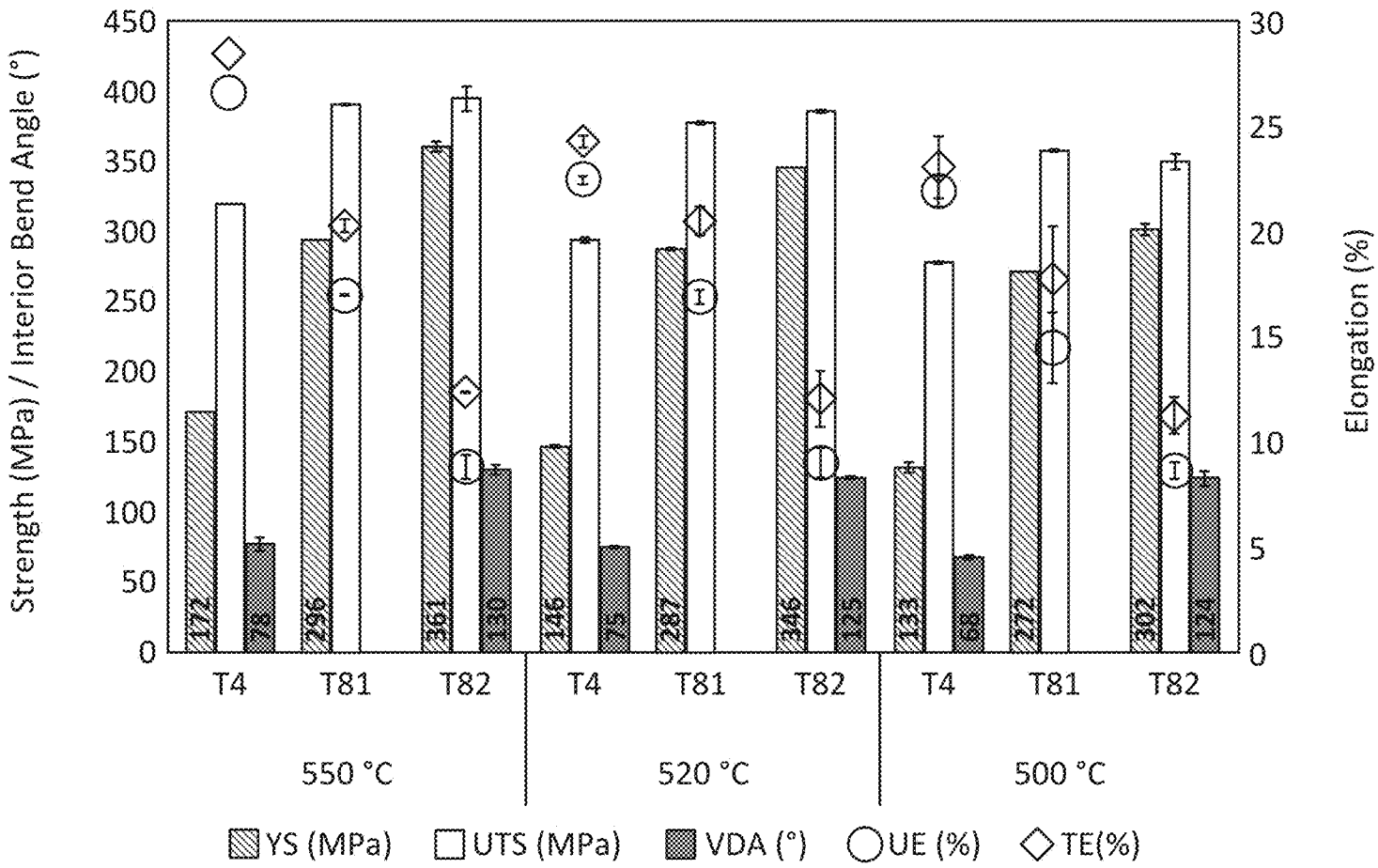
FIG. 5 is a graph showing the tensile properties of continuously cast exemplary alloy B processed by the route described in FIG. 1A. HR+WQ+CR using three different solutionizing temperatures as indicated in the graph and in the T4, T81, and T82 tempers. The left histogram bar in each set represents the yield strength of the alloy made according to different methods of making. The center histogram bar in each set represents the ultimate tensile strength of the alloy made according to different methods of making. The right histogram bar in each set represents the bend angle of the alloy made according to different methods of making. Elongation is represented by unfilled point markers. The diamond in each set represents the total elongation of the alloy made according to different methods of making, and the circle in each set represents the uniform elongation of the alloy made according to different methods of making.
Figure 6:
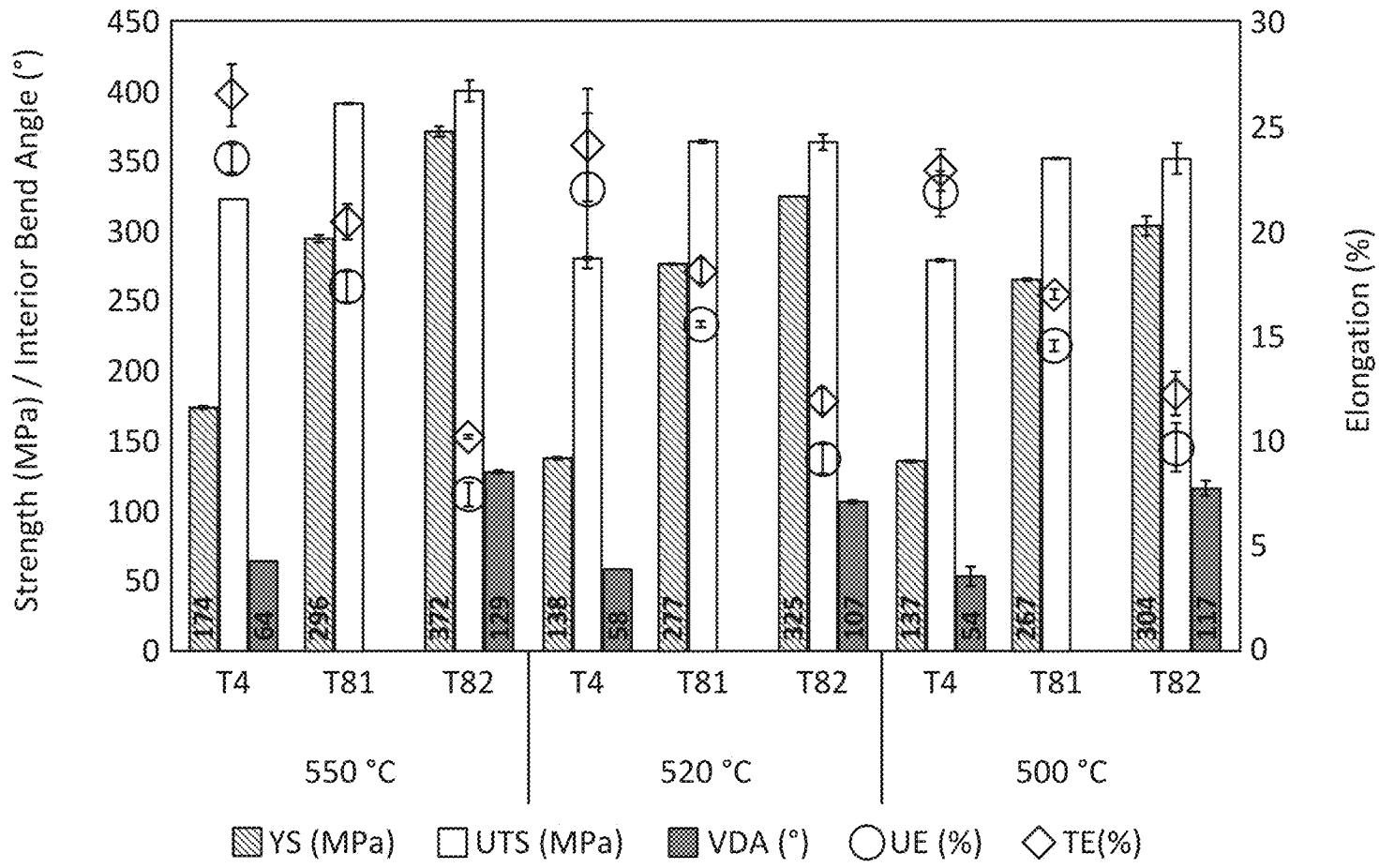
FIG. 6 is a graph showing the tensile properties of continuously cast exemplary alloy B processed by the route described in FIG. 1B ("HRTG") using three different solutionizing temperatures as indicated in the graph and in the T4, T81, and T82 tempers. The left histogram bar in each set represents the yield strength of the alloy made according to different methods of making. The center histogram bar in each set represents the ultimate tensile strength of the alloy made according to different methods of making. The right histogram bar in each set represents the bend angle of the alloy made according to different methods of making. Elongation is represented by unfilled point markers. The diamond in each set represents the total elongation of the alloy made according to different methods of making, and the circle in each set represents the uniform elongation of the alloy made according to different methods of making.

The mechanical properties for continuously cast exemplary alloy B are shown in FIGS. 5 and 6. FIG. 5 presents the mechanical properties of the continuously cast exemplary alloy B obtained from process route HR+WQ+CR. FIG. 6 presents the mechanical properties of the continuously cast exemplary alloy B obtained from process route HRTG. Yield strength (YS) (left histogram, hatch filled), ultimate tensile strength (UTS) (center histogram, cross-hatch filled), and bend angle (VDA) (right histogram, vertical line filled) are represented by histograms and uniform elongation (UE) (unfilled circle) and total elongation (TE) (unfilled diamond) are represented by unfilled point markers. The alloys were tested after natural aging (T4) and after artificial aging (T81 and T82) steps as described herein. Alloy B showed similar properties when compared to alloy A with slightly higher tensile strength and slightly diminished bend angle. The slight difference in mechanical properties can be attributed to the higher Si content of alloy B (0.14 wt. % greater than alloy A).

Figure 7:
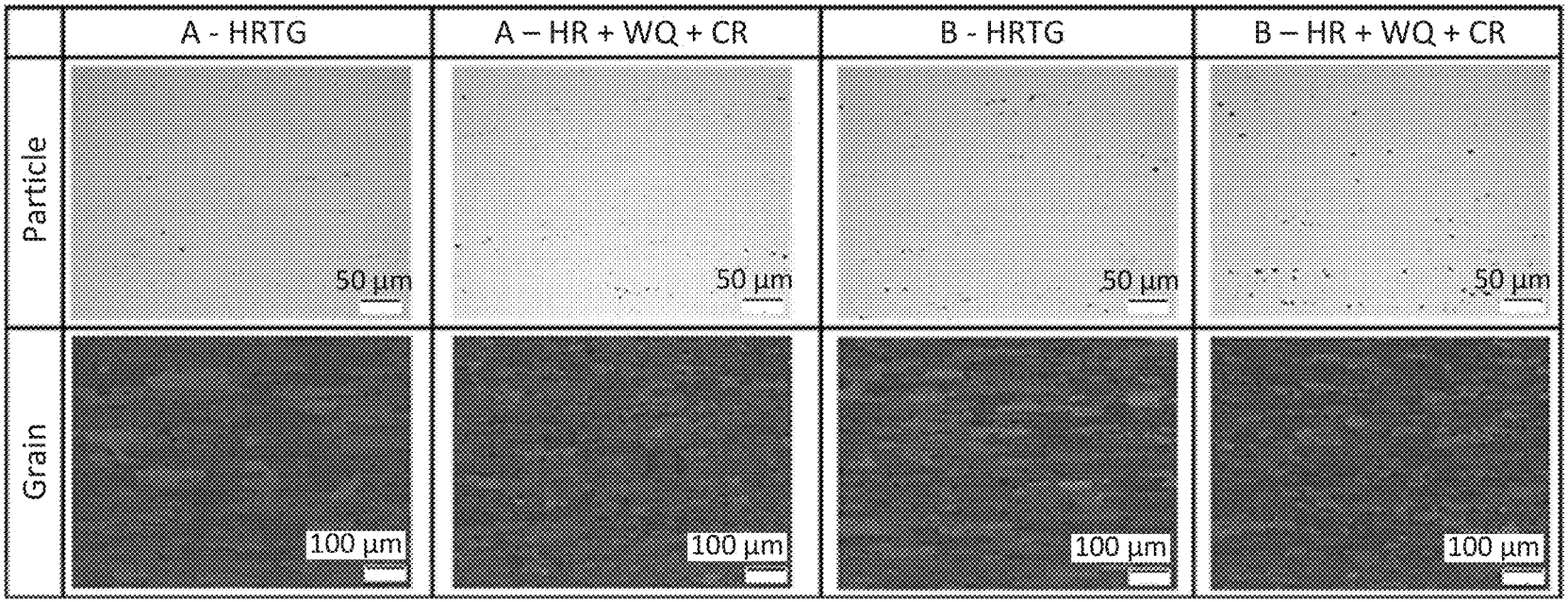
FIG. 7 shows digital images of the particle content and grain structures of exemplary alloys described herein. The top row ("Particle") shows the particle content of exemplary alloys processed by exemplary ("A-HRTG", "B-HRTG") and comparative ("A-HR+WQ+CR", "B-HR+WQ+CR") routes. The bottom row ("Grain") shows the grain structure of exemplary alloys processed by the exemplary and comparative routes.

The increase in strength and formability that was provided by continuous casting 6xxx series aluminum alloys A and B can be attributed to the difference in microstructure. FIG. 7 shows the magnesium silicide ($Mg_2Si$) particle size and morphology (top row, "Particle") and grain structure (bottom row, "Grain"). An elongated grain structure and smaller, fewer undissolved $Mg_2Si$ particles were observed in the continuously cast alloys (A and B) that were subjected to the exemplary processing route HRTG when compared to the continuously cast exemplary alloys (A and B) processed by the more traditional HR+WQ+CR route. The HR+WQ+CR route provided a more equiax recrystallized grain structure and a larger amount of coarse, undissolved $Mg_2Si$ particles.

Figure 8:
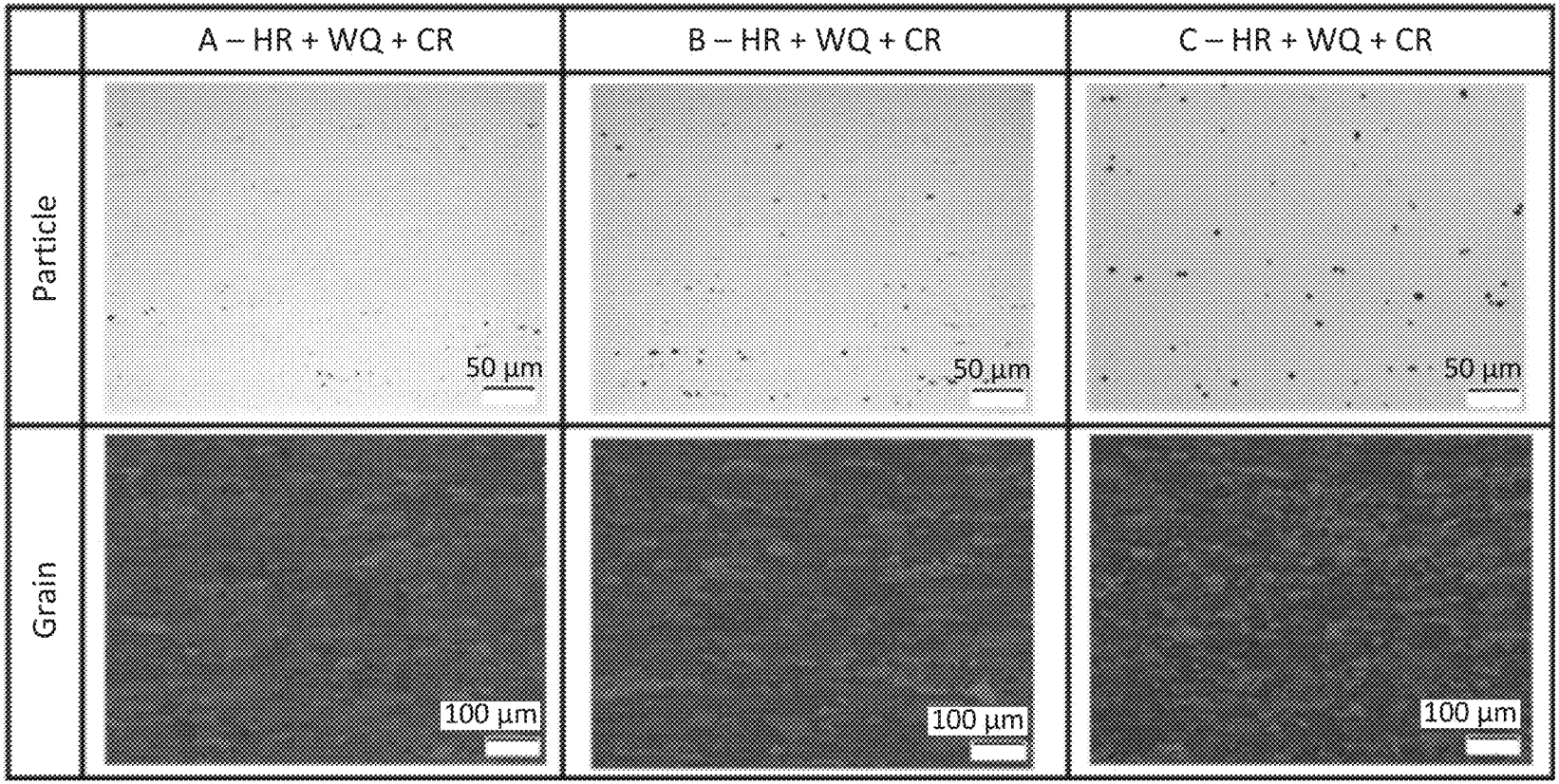
FIG. 8 shows digital images of the particle content and grain structures of exemplary and comparative alloys described herein. The top row ("Particle") shows the particle content of exemplary (A, B) and comparative (C) alloys processed by a comparative route (hot rolling and cold rolling, "A-HR+WQ+CR," "B-HR+WQ+CR," "C-HR+WQ+CR"). The bottom row ("Grain") shows the grain structure of the exemplary and comparative alloys processed by the comparative route.

FIG. 8 presents the microstructure of the continuously cast exemplary alloys A and B compared to the microstructure of the DC cast comparative alloy C. Each alloy was subjected to a traditional hot roll, cold roll processing procedure and naturally aged to obtain a T4-temper condition. The images were obtained from the longitudinal cross section of each sample. The DC cast alloy C shows coarse $Mg_2Si$ particles and a recrystallized grain structure comprised of smaller individual grains. The difference in microstructure can be attributed to the higher solute content (Mg and Si) and the cold rolling step during processing.

Exemplary alloys A and B are low in solute content when compared to comparative alloy C which can contribute to an improved formability of the as-produced aluminum alloy sheets, plates or shates. Specifically, the primary alloying elements for a 6xxx series aluminum alloy, Mg and Si, as well as Cu, are significantly reduced and the resulting aluminum alloys exhibit comparable strength and superior formability when compared to conventional DC cast 6xxx series aluminum alloys. Conventional DC cast 6xxx aluminum alloys contain higher amounts of Mg, Si and/or Cu solutes and often these solutes result in undissolved precipitates present in the aluminum matrix. However, in CC aluminum alloys, the solutes present in the aluminum matrix will precipitate out of the aluminum matrix during the artificial aging step following the exemplary HRTG processing route. Aluminum alloys processed via the comparative HR+WQ+CR route exhibit solute precipitation regardless of casting technique. The exemplary alloys A and B described herein contain finer constituent $Mg_2Si$ particles and result in a super-saturated solid solution matrix (SSSS). Hot rolling continuously cast alloys to a final gauge (HRTG) can produce superior performing aluminum alloys with high strength and better bendability compared to traditional hot rolled and cold rolled DC alloys.

Example 2

Various alloys were prepared for strength, elongation, and formability testing. The chemical compositions for these alloys are provided in Table 6 below.

TABLE 6

| Element | Alloy D | Alloy E | Alloy F | Alloy G | Alloy H | Alloy I |
|---|---|---|---|---|---|---|
| Si | 0.70 | 0.95 | 0.80 | 1.13 | 0.81 | 0.87 |
| Fe | 0.20 | 0.20 | 0.20 | 0.20 | 0.19 | 0.20 |
| Cu | 0.85 | 0.80 | 0.80 | 0.79 | 0.69 | 0.40 |
| Mn | 0.30 | 0.18 | 0.18 | 0.10 | 0.16 | 0.18 |
| Mg | 0.90 | 0.80 | 0.80 | 1.13 | 1.17 | 0.67 |
| Cr | 0.03 | 0.07 | 0.07 | 0.07 | 0.03 | 0.07 |
| Ti | 0.04 | 0.02 | 0.02 | 0.02 | 0.01 | 0.02 |
| Zr | 0.12 | 0 | 0 | 0 | 0 | 0 |
| Impurities | 0.05 (each) | 0.05 (each) | 0.05 (each) | 0.05 (each) | 0.05 (each) | 0.05 (each) |
| | 0.15 (total) | 0.15 (total) | 0.15 (total) | 0.15 (total) | 0.15 (total) | 0.15 (total) |
| Al | Remainder | Remainder | Remainder | Remainder | Remainder | Remainder |

All values expressed as weight percentage (wt. %) of the whole.

Example 2A

Alloys having the compositions of Alloys D-I were subjected to a method of production including casting a slab; homogenizing the slab before hot rolling; hot rolling the slab to produce a hot rolled aluminum alloy having an intermediate gauge (e.g., an intermediate gauge aluminum alloy article); quenching the intermediate gauge aluminum alloy article; cold rolling the intermediate gauge aluminum alloy article to provide a final gauge aluminum alloy article; solutionizing the final gauge aluminum alloy article; and artificially aging the final gauge aluminum alloy article. The method is referred to as "Flash→WQ→CR" and depicted in FIG. 9. The method steps are further described below.

Exemplary Alloys D-I (see Table 6) were provided in a T81 temper and a T82 temper by employing the methods described above and optional artificial aging. Each of the exemplary Alloys D-I was produced by casting an aluminum alloy article 910 such that the aluminum alloy article exiting a continuous caster 920 had a caster exit temperature of about 450° C., homogenizing in a tunnel furnace 930 at a temperature of from about 550° C. to about 570° C. for 2 minutes, subjecting the aluminum alloy article 910 to about a 50% to about a 70% reduction in a rolling mill 940 at a temperature between approximately 530° C. and 580° C., and water quenching the aluminum alloy article 910 with a quenching device 950. The aluminum alloy article 910 was then cold rolled in a cold mill 960 to a final gauge of 2.0 mm.

Figure 10:
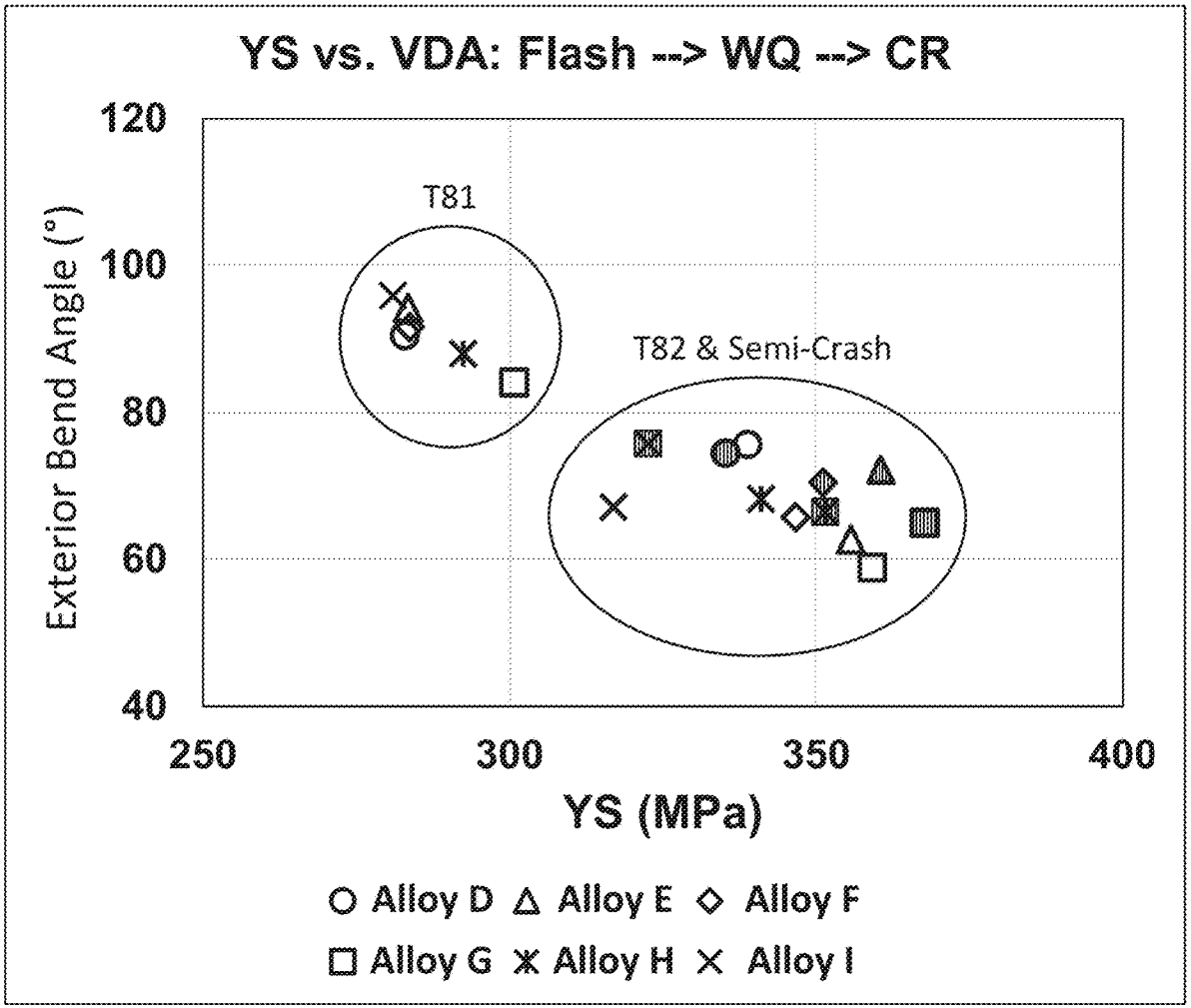
FIG. 10 is a graph of mechanical properties of aluminum alloys processed by the route described in FIG. 9. The VDA bending and yield strength data are shown.

For T81 temper, the exemplary aluminum alloys were artificially aged at 185° C. for 20 minutes after pre-straining the exemplary aluminum alloys by 2%. For T82 temper, the exemplary aluminum alloys were artificially aged at 225° C. for 30 minutes. For a Semi-Crash condition, the exemplary aluminum alloys were artificially aged at 185° C. for 20 minutes after pre-straining the exemplary aluminum alloys by 10%. Mechanical properties of the exemplary aluminum alloys are shown in FIG. 10. Open symbols represent the exemplary alloys having T81 temper and T82 temper properties. Filled symbols represent the exemplary alloys having Semi-Crash properties. Bend angle data is normalized for 2.0 mm thickness according to specification VDA 239-200 and the VDA bending test was performed according to VDA specification 238-100. Exemplary Alloys D, E, and F exhibited high strength and excellent deformability (e.g., displayed a bend angle greater than 60°).

Example 2B

Alloys having the compositions of Alloys D-I (see Table 6) were subjected to a method of production including casting a slab; homogenizing the slab before hot rolling; quenching the slab before hot rolling; hot rolling the slab to produce a hot rolled aluminum alloy having an intermediate gauge (e.g., an intermediate gauge aluminum alloy article); quenching the intermediate gauge aluminum alloy article; preheating the intermediate gauge aluminum alloy; quenching the preheated intermediate gauge aluminum alloy; warm rolling the intermediate gauge aluminum alloy article to provide a final gauge aluminum alloy article; quenching the final gauge aluminum alloy article; solutionizing the final gauge aluminum alloy article; and artificially aging the final gauge aluminum alloy article. The method is referred to as "Flash→WQ→HO→WQ to 350° C.→WR" and depicted in FIG. 11. The method steps are further described below.

Exemplary Alloys D-I (see Table 6) were provided in a T81 temper and a T82 temper by employing the methods described above and optional artificial aging. Each of the exemplary Alloys D-I were produced by casting an exemplary aluminum alloy article 910 such that the aluminum alloy article 910 exiting a continuous caster 920 had a caster exit temperature of about 450° C., homogenizing in a tunnel furnace 930 at a temperature of from about 550° C. to about 570° C. for 2 minutes, water quenching the aluminum alloy article 910, subjecting the aluminum alloy article 910 to about a 50% to about a 70% reduction in a rolling mill 940 at a temperature between approximately 530° C. and 580° C., and water quenching the aluminum alloy article 910 with a quenching device 950. The aluminum alloy article 910 was then preheated in a box furnace 1110 at a temperature of from about 530° C. to about 560° C. for 1 to 2 hours. The aluminum alloy article 910 was then water quenched to a temperature of about 350° C. using a quenching device 1120 before cold rolling. The aluminum alloy article 910 was then cold rolled in a cold mill 1130 to a final gauge of 2.0 mm and water quenched to 50° C. using a quenching device 1140.

Figure 12:
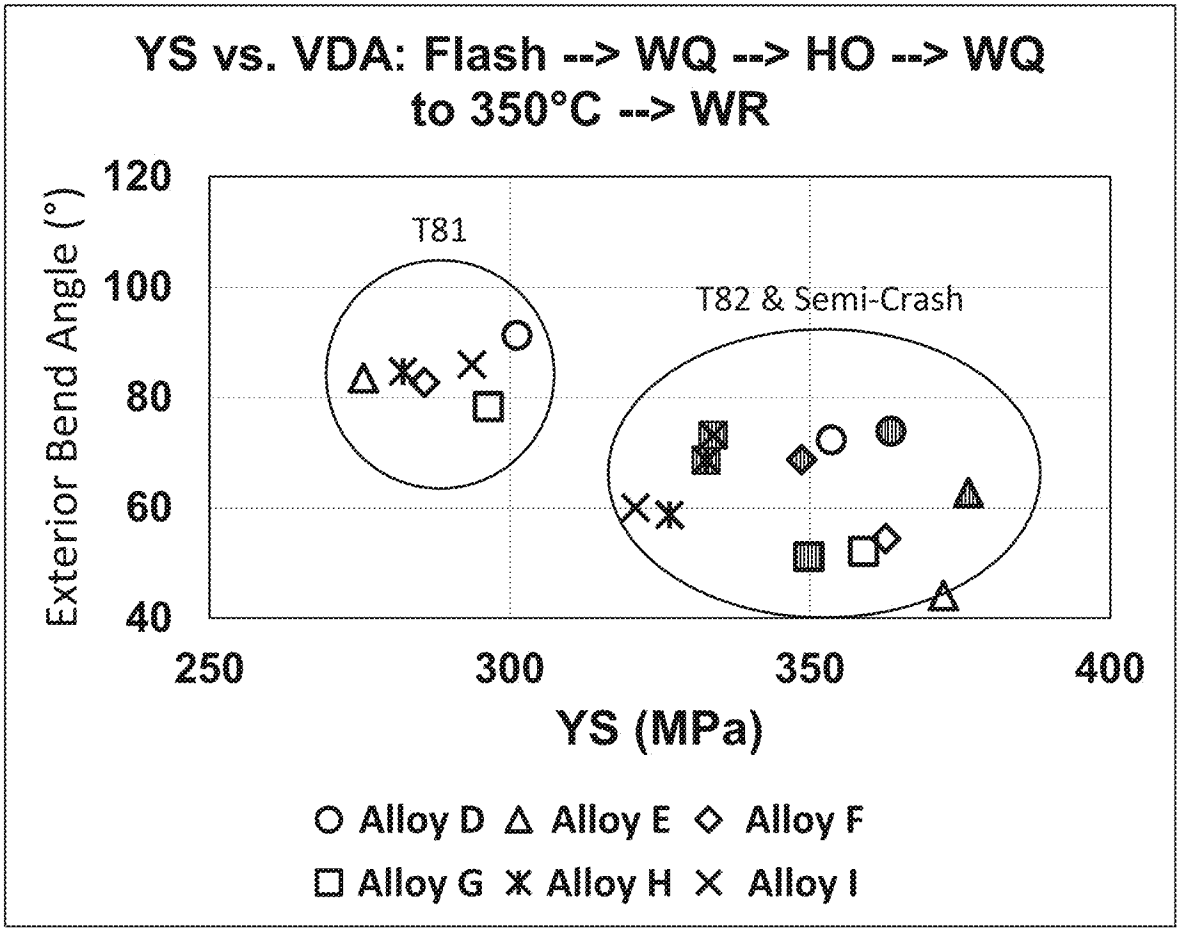
FIG. 12 is a graph of mechanical properties of aluminum alloys processed by the route described in FIG. 11. The VDA bending and yield strength data are shown.

For T81 temper, the exemplary aluminum alloys were artificially aged at 185° C. for 20 minutes after pre-straining the exemplary aluminum alloys by 2%. For T82 temper, the exemplary aluminum alloys were artificially aged at 225° C. for 30 minutes. For a Semi-Crash condition, the exemplary aluminum alloys were artificially aged at 185° C. for 20 minutes after pre-straining the exemplary aluminum alloys by 10%. Mechanical properties of the exemplary aluminum alloys are shown in FIG. 12. Open symbols represent the exemplary alloys having T81 temper and T82 temper properties. Filled symbols represent the exemplary alloys having Semi-Crash properties. Bend angle data is normalized for 2.0 mm thickness according to specification VDA 239-200 and the VDA bending test was performed according to VDA specification 238-100. Exemplary Alloys D, E, and F exhibited high strength and excellent deformability (e.g., having a bend angle greater than 60°).

Example 2C

Alloys having the compositions of Alloys D-I (see Table 6) were subjected to a method of production including casting a slab; homogenizing the slab before hot rolling; quenching the slab before hot rolling; hot rolling the slab to produce a hot rolled aluminum alloy having a first intermediate gauge (e.g., a first intermediate gauge aluminum alloy article); quenching the first intermediate gauge aluminum alloy article; preheating the first intermediate gauge aluminum alloy; hot rolling the first intermediate gauge aluminum alloy article to provide a second intermediate gauge aluminum alloy article; quenching the second intermediate gauge aluminum alloy article; cold rolling the second intermediate gauge aluminum alloy article to provide a final gauge aluminum alloy article; quenching the final gauge aluminum alloy article; solutionizing the final gauge aluminum alloy article; and artificially aging the final gauge aluminum alloy article. The method is referred to as "Flash→WQ→HO→HR→WQ→CR" and depicted in FIG. 13. The method steps are further described below.

Exemplary Alloys D-I (see Table 6) were provided in a T81 temper and a T82 temper by employing the methods described above and optional artificial aging. Each of the exemplary Alloys D-I were produced by casting an exemplary aluminum alloy article 910 such that the aluminum alloy article 910 exiting a continuous caster 920 had a caster exit temperature of about 450° C., homogenizing in a tunnel furnace 930 at a temperature of from about 550° C. to about 570° C. for 2 minutes, water quenching the homogenized aluminum alloy article 910, subjecting the aluminum alloy article 910 to about a 50% reduction in thickness in a rolling mill 940 at a temperature between approximately 530° C. and 580° C., and water quenching the aluminum alloy article 910 with a quenching device 950. The aluminum alloy article 910 was then preheated in a box furnace 1110 at a temperature of from about 530° C. to about 560° C. for 1 to 2 hours. The aluminum alloy article was then further hot rolled to about a 70% reduction in thickness in the rolling mill 940 at a temperature between approximately 530° C. and 580° C., and water quenched with the quenching device 950. The aluminum alloy article 910 was then cold rolled in a cold mill 1130 to a final gauge of 2.0 mm and water quenched to 50° C. using a quenching device 1140.

Figure 14:
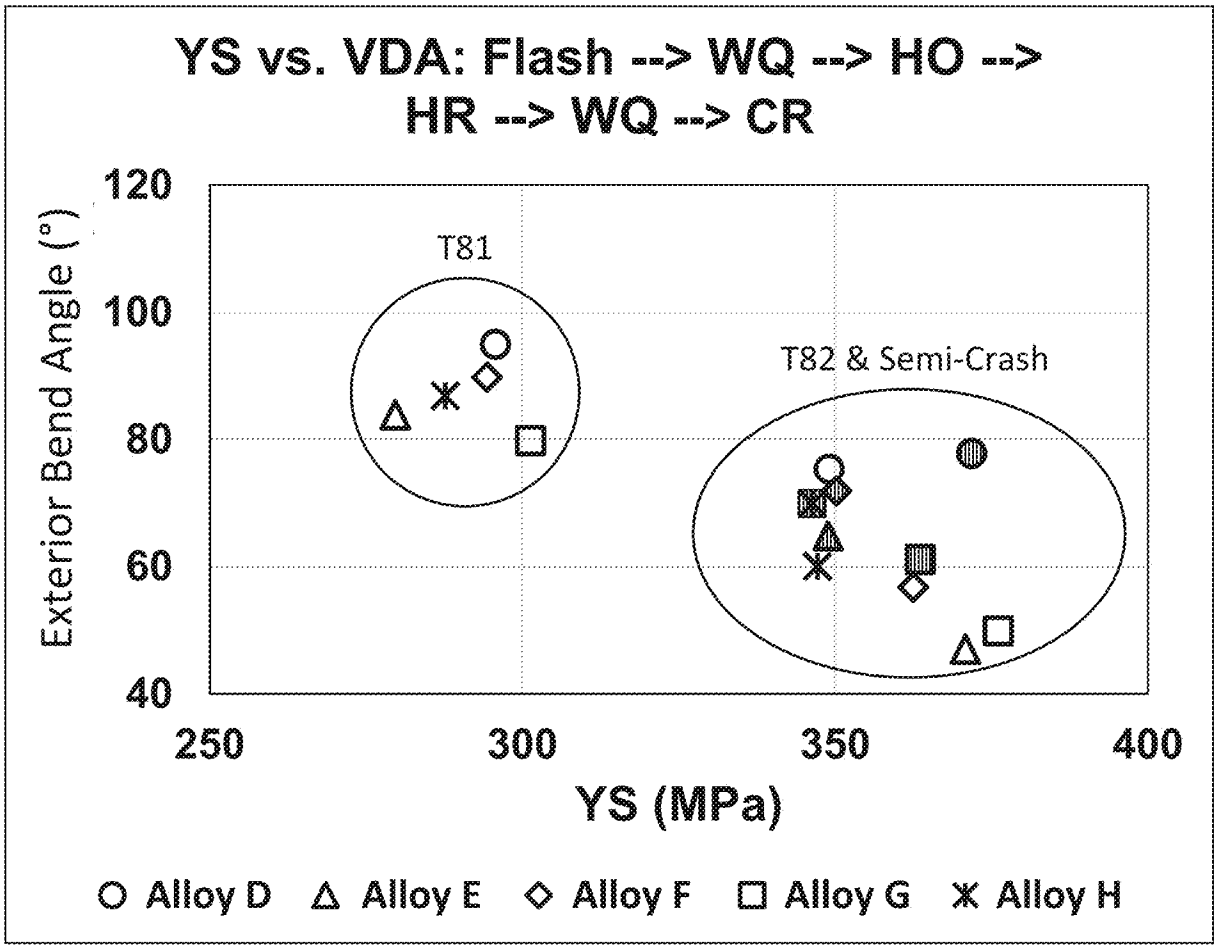
FIG. 14 is a graph of mechanical properties of aluminum alloys processed by the route described in FIG. 13. The VDA bending and yield strength data are shown.

For T81 temper, the exemplary aluminum alloys were artificially aged at 185° C. for 20 minutes after pre-straining the exemplary aluminum alloys by 2%. For T82 temper, the exemplary aluminum alloys were artificially aged at 225° C. for 30 minutes. For a Semi-Crash condition, the exemplary aluminum alloys were artificially aged at 185° C. for 20 minutes after pre-straining the exemplary aluminum alloys by 10%. Mechanical properties of the exemplary aluminum alloys are shown in FIG. 14. Open symbols represent the exemplary alloys having T81 temper and T82 temper properties. Filled symbols represent the exemplary alloys having Semi-Crash properties. Bend angle data is normalized for 2.0 mm thickness according to specification VDA 239-200 and the VDA bending test was performed according to VDA specification 238-100. Exemplary Alloys D, and F exhibited high strength and excellent deformability (e.g., having a bend angle greater than 60°).

Example 2D

Alloys having the compositions of Alloys D-I (see Table 6) were subjected to a method of production including casting a slab; homogenizing the slab before hot rolling; quenching the slab before hot rolling; hot rolling the slab to produce a hot rolled aluminum alloy having an intermediate gauge (e.g., an intermediate gauge aluminum alloy article); quenching the intermediate gauge aluminum alloy article; preheating the intermediate gauge aluminum alloy; quenching the preheated intermediate gauge aluminum alloy; cold rolling the intermediate gauge aluminum alloy article to provide a final gauge aluminum alloy article; solutionizing the final gauge aluminum alloy article; and artificially aging the final gauge aluminum alloy article. The method is referred to as "Flash→WQ→HO→WQ→CR" and depicted in FIG. 15. The method steps are further described below.

Exemplary Alloys D-I (see Table 6) were provided in a T81 temper and a T82 temper by employing the methods described above and optional artificial aging. Each of the exemplary Alloys D-I were produced by casting an exemplary aluminum alloy article 910 such that the aluminum alloy article 910 exiting a continuous caster 920 has a caster exit temperature of about 450° C., homogenizing in a tunnel furnace 930 at a temperature of from about 550° C. to about 570° C. for 2 minutes, water quenching the flash homogenized aluminum alloy article 910, subjecting the aluminum alloy article 910 to about a 50% to about a 70% reduction in a rolling mill 940 at a temperature between approximately 530° C. and 580° C., and water quenching the aluminum alloy article 910 with a quenching device 950. The aluminum alloy article 910 was then preheated in a box furnace 1110 at a temperature of from about 530° C. to about 560° C. for 1 to 2 hours. The aluminum alloy article 910 was then water quenched to a temperature of about 50° C. using a quenching device 1120 before cold rolling. The aluminum alloy article 910 was then cold rolled in a cold mill 1130 to a final gauge of 2.0 mm.

Figure 16:
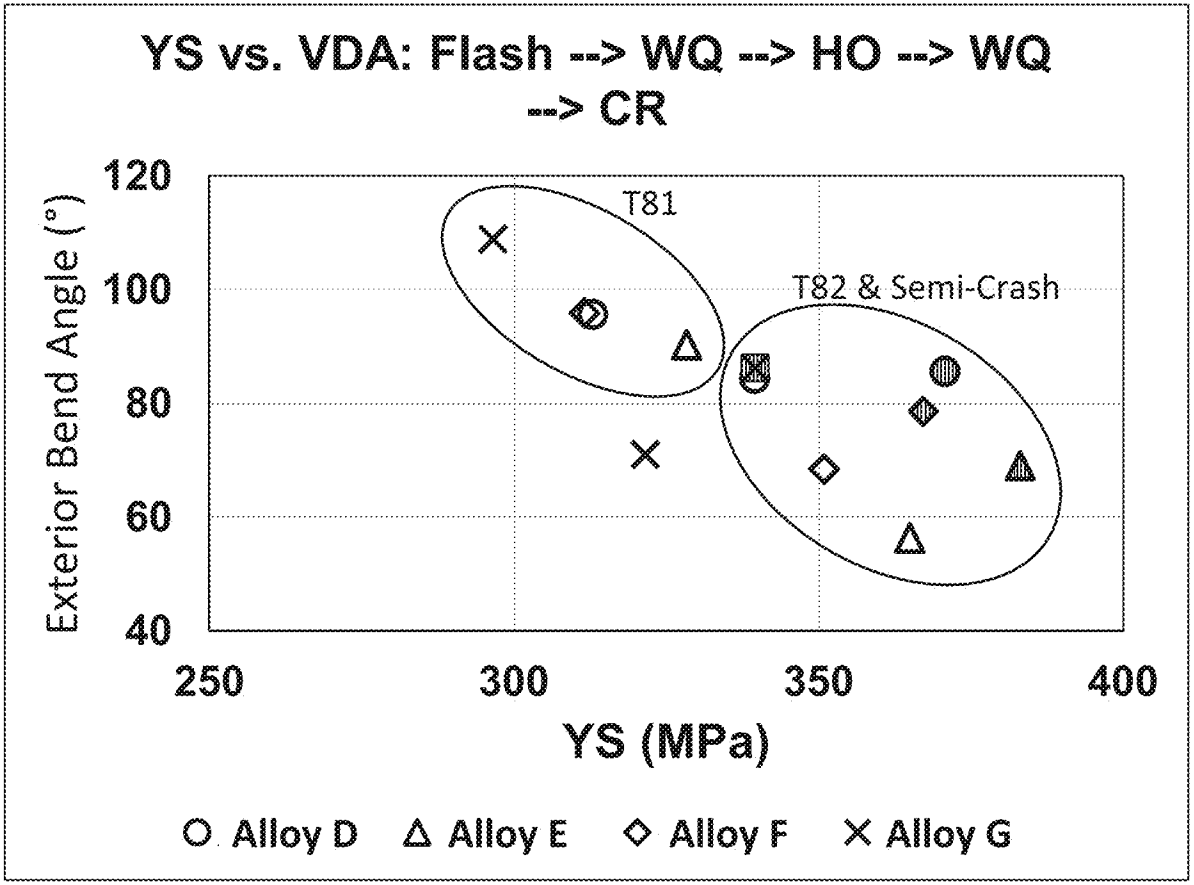
FIG. 16 is a graph of mechanical properties of aluminum alloys processed by the route described in FIG. 15. The VDA bending and yield strength data are shown.

For T81 temper, the exemplary aluminum alloys were artificially aged at 185° C. for 20 minutes after pre-straining the exemplary aluminum alloys by 2%. For T82 temper, the exemplary aluminum alloys were artificially aged at 225° C. for 30 minutes. For a Semi-Crash condition, the exemplary aluminum alloys were artificially aged at 185° C. for 20 minutes after pre-straining the exemplary aluminum alloys by 10%. Mechanical properties of the exemplary aluminum alloys are shown in FIG. 16. Open symbols represent the exemplary alloys having T81 temper and T82 temper properties. Filled symbols represent the exemplary alloys having Semi-Crash properties. Bend angle data is normalized for 2.0 mm thickness according to specification VDA 239-200 and the VDA bending test was performed according to VDA specification 238-100. Exemplary Alloys D, and F exhibited high strength and excellent deformability (e.g., having a bend angle greater than 60°).

Example 2E

Alloys having the compositions of Alloys D-I (see Table 6) were subjected to a method of production including casting a slab; homogenizing the slab before hot rolling; hot rolling the slab to produce a hot rolled aluminum alloy having an intermediate gauge (e.g., an intermediate gauge aluminum alloy article); quenching the intermediate gauge aluminum alloy article; cold rolling the intermediate gauge aluminum alloy article to provide a final gauge aluminum alloy article; and solutionizing the final gauge aluminum alloy article. The method steps are depicted in FIG. 9 and further described below.

Figure 17:
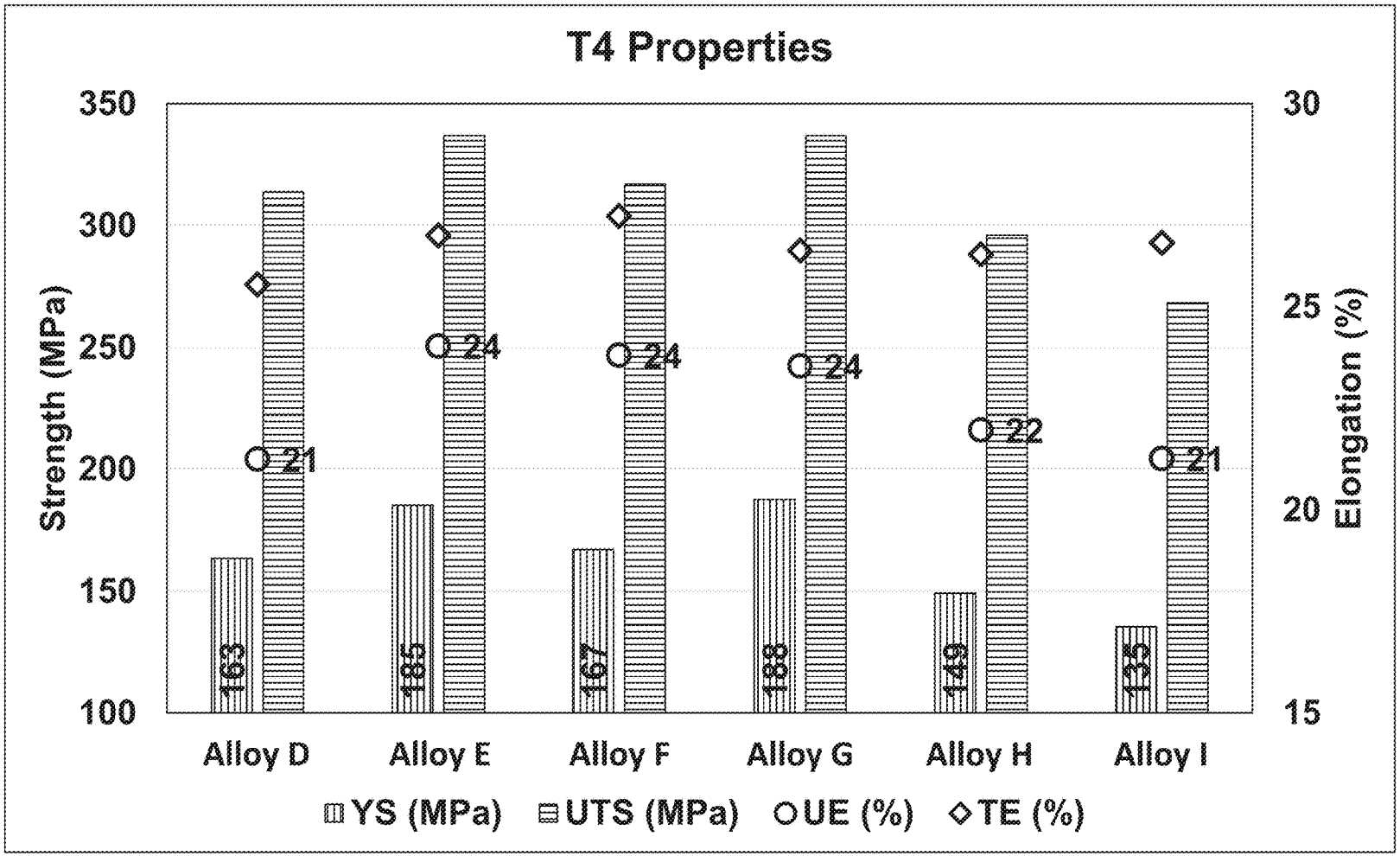
FIG. 17 is a graph of mechanical properties of aluminum alloys produced according to certain aspects of the present disclosure. The left histogram bar in each set represents the yield strength of the alloys. The right histogram bar in each set represents the ultimate tensile strength of the alloys. Elongation is represented by unfilled point markers. The diamond in each set represents the total elongation of the alloys, and the circle in each set represents the uniform elongation of the alloys.

Exemplary Alloys D-I (see Table 6) were provided in a T4 temper by employing the methods described above and optional natural aging. Each of exemplary Alloys D-I were produced by casting an exemplary aluminum alloy article 910 such that the aluminum alloy article exiting a continuous caster 920 had a caster exit temperature of about 450° C., homogenizing in a tunnel furnace 930 at a temperature of from about 550° C. to about 570° C. for 2 minutes, subjecting the aluminum alloy article 910 to about a 50% to about a 70% reduction in a rolling mill 940 at a temperature between approximately 530° C. and 580° C., and water quenching the aluminum alloy article 910 with a quenching device 950. The aluminum alloy article 910 was then cold rolled in a cold mill 960 to a final gauge of 2.0 mm. For T4 temper, the exemplary aluminum alloys were naturally aged for about 3 weeks to about 4 weeks. Mechanical properties of the exemplary aluminum alloys are shown in FIG. 17. Yield strength (left vertical-striped histogram in each group), ultimate tensile strength (right horizontal-striped histogram in each group), uniform elongation (open circles) and total elongation (open diamonds) are shown for the exemplary alloys in T4 temper. Exemplary Alloys E and G exhibited high strength and excellent deformability.

Various embodiments of the invention have been described in fulfillment of the various objectives of the invention. It should be recognized that these embodiments are merely illustrative of the principles of the present invention. Numerous modifications and adaptations thereof will be readily apparent to those of ordinary skill in the art without departing from the spirit and scope of the invention as defined in the following claims.

What is claimed is:

1. An aluminum alloy product prepared according to a method comprising:

continuously casting an aluminum alloy to form a slab, wherein the aluminum alloy comprises about 0.26-2.82 wt. % Si, 0.06-0.60 wt. % Fe, 0.26-2.37 wt. % Cu, 0.06-0.57 wt. % Mn, 0.26-2.37 wt. % Mg, 0-0.21 wt. % Cr, 0-0.009 wt. % Zn, 0-0.09 wt. % Ti, 0-0.003 wt. % Zr and up to 0.15 wt. % of impurities, with the remainder Al; and hot rolling the slab to a final gauge without cold rolling the slab prior to the final gauge, wherein the aluminum alloy product comprises an interior bend angle of from about 35° to about 65° when in a T4-temper, from about 110° to about 130° when in a T82-temper, and from about 90° to about 130° when in a semi-crash condition.

2. The aluminum alloy product of claim 1, wherein the aluminum alloy product is an aluminum alloy sheet, an aluminum alloy plate, or an aluminum alloy shate.

3. The aluminum alloy product of claim 1, wherein the aluminum alloy product comprises a long transverse tensile yield strength of at least about 365 MPa when in a T82-temper.

4. The aluminum alloy product of claim 1, wherein the aluminum alloy product is an automotive body part, a motor vehicle part, a transportation body part, an aerospace body part, or an electronics housing.

5. The aluminum alloy product of claim 1, wherein the aluminum alloy comprises about 0.52-1.18 wt. % Si, 0.13-0.30 wt. % Fe, 0.52-1.18 wt. % Cu, 0.12-0.28 wt. % Mn, 0.52-0.001 wt. % Zr and up to 0.15 wt. % of impurities, with the remainder Al.

6. The aluminum alloy product of claim 1, wherein the aluminum alloy comprises about 0.70-1.0 wt. % Si, 0.15-0.25 wt. % Fe, 0.70-0.90 wt. % Cu, 0.15-0.25 wt. % Mn, 0.70-0.90 wt. % Mg, 0.05-0.10 wt. % Cr, 0.002-0.004 wt. % Zn, 0.01-0.03 wt. % Ti, 0.0006-0.001 wt. % Zr and up to 0.15 wt. % of impurities, with the remainder Al.

* * * * *